US005673071A

United States Patent [19]

Fuse

[11] Patent Number: 5,673,071

[45] Date of Patent: Sep. 30, 1997

[54] PREPARATORY HEAD DRIVE METHOD FOR AN INK JET PRINTER

[75] Inventor: Takeshi Fuse, Ebina, Japan

[73] Assignee: Fuji Xerox Co., Ltd., Tokyo, Japan

[21] Appl. No.: 121,469

[22] Filed: Sep. 16, 1993

[30] Foreign Application Priority Data

Sep. 18, 1992 [JP] Japan ..... 4-273421

[51] Int. Cl.[6] ..... B41J 2/165

[52] U.S. Cl. ..... 347/35; 347/14; 347/60

[58] Field of Search ..... 347/9, 10, 11, 347/13, 14, 17, 35, 57, 58, 60

[56] References Cited

U.S. PATENT DOCUMENTS

| | | | |
|---|---|---|---|
| 4,791,435 | 12/1988 | Smith et al. | 347/60 |
| 4,973,984 | 11/1990 | Sasaki | 347/182 |
| 5,172,134 | 12/1992 | Kishida et al. | 347/56 |
| 5,359,352 | 10/1994 | Saita et al. | 347/62 |

FOREIGN PATENT DOCUMENTS

| | | | |
|---|---|---|---|
| 61-146548 | 7/1986 | Japan | 347/60 |
| 64-38246 | 2/1989 | Japan . | |
| 4-44856 | 2/1992 | Japan . | |
| 5-169674 | 7/1993 | Japan | 347/17 |

*Primary Examiner*—John E. Barlow, Jr.
*Attorney, Agent, or Firm*—Finnegan, Henderson, Farabow, Garrett & Dunner, L.L.P.

[57] ABSTRACT

A preparatory head drive method for an ink jet printer having heads each including a plural number of nozzles. In the method, a discharging, preparatory drive method for effecting the head temperature rise by driving the nozzles so as to discharge ink and a heating, preparatory drive method for effecting the same by driving the nozzles to such an extent as not to discharge ink are alternately executed.

9 Claims, 10 Drawing Sheets

PREPARATORY HEAD DRIVE METHOD FOR AN INK JET PRINTER

BACKGROUND OF THE INVENTION

1. Field of the Invention

The present invention relates to an ink jet printer which carries out a recording or printing operation by jetting ink droplets toward a recording medium, and more particularly, to a preparatory head drive control method for a printing head.

2. Discussion of the Related Art

An ink jet printer in which a heater heats ink to generate an ink bubble, and the pressure generated when the bubble expands causes a print head to jet ink droplets toward a recording medium, has been developed.

In the ink jet printer, ink is always supplied up to the tip of the nozzle of the print head. When the printer is unused for printing for a long time, the ink will dry. To prevent the ink from drying, a structure to cover the print head with an airtight cap is employed. Actually, it is very difficult to maintain a constant airtight seal within the cap for a long time. Accordingly, when the printer is left unused for a long time, moisture and volatile components are gradually discharged from the ink remaining in the vicinity of the nozzle discharge openings. As a result, of the physical properties of the ink, viscosity in particular is increased, hindering the discharging action of ink. Under this condition, when the printer performs a normal print operation, the ink remaining in the nozzle discharge openings is not discharged or even if it is discharged, it is discharged in an indefinite direction, resulting in print failure or poor print image.

Such a disadvantageous situation will occur when the printer is located in low temperature conditions as well as when it is left not operated for a long time. During the printing operation by the printer, the temperature of the printer head is kept at an optimum temperature so that a stable print operation is secured. When the printer is left unused for a long time, the head temperature gradually drops. The drop of the head temperature or the drop of ink temperature leads to an increase in the ink's viscosity. Also, when the printer is located in low temperature conditions, the printer will suffer from print failure and poor print quality similar to when it is left unused for a long time. Further, the printer will experience a decrease in the quantity of discharged ink drops. In this case, the resultant print image has an insufficient density.

In view of the above circumstances, it is ideal that the physical properties of the ink are kept stable against temperature variation, even when the printer is not operated for a long time. Attempts have been made to improve the head drive method to prevent print failure and the like. One of the known print drive methods is to preliminarily drive the print head before the print operation, thereby setting up an easy-to-ink-discharge state.

Japanese Patent Laid-Open Publication No. Sho. 64-38246 discloses a unique head drive control method. In the method, when judgement is made that ink of high viscosity is present at the nozzle or that the head temperature is lower than a preset temperature, the nozzle is driven by any of three nozzle drive methods: 1) the nozzle is driven to such an extent as to not discharge ink, 2) the nozzle is driven to discharge ink, and 3) the nozzle is driven to such an extent as to not discharge ink and subsequently the nozzle is driven to discharge ink. The judgement and the nozzle drive operations are carried out before the subsequent print operation. As a result, the print failure is avoided.

Where the printer is left unused for a long time or located in low temperature conditions, the ink remaining near the nozzle discharge openings of the printer head has a high viscosity, as mentioned above. Under this condition, if the first nozzle drive method in which the nozzle is driven to such an extent as to not discharge ink is used, the head temperature is increased. Accordingly, the viscosity of the ink near the nozzle discharge openings is reduced, so that the nozzle is placed in an easy-to-discharge state. The moisture and volatile components of the ink near the nozzle discharge openings have been evaporated before this preparatory drive operation; therefore, the ink density of the first printed character is high. If the second nozzle drive method in which the nozzle is driven to discharge ink is used, the evaporations of the moisture and volatile components are different nozzle by nozzle. The ink viscosities of the nozzles are also not uniform. Accordingly, some nozzles discharge ink and some nozzles barely discharge ink. In this case, a measure may be taken in which the number of preparatory head drive operations is preset so as to regain the normal discharge function of those nozzles that are barely capable of discharging ink. If this measure is taken, the nozzles capable of normally discharging ink continuously discharge ink wastefully while the preset number of preparatory head drive operations are carried out. If the number of preparatory head drive operations is decreased, the wasteful discharge of ink is indeed reduced, but the cure of the clogged state of the nozzles is imperfect. Some of the nozzles remain clogged, possibly causing print failure. Thus, this preparatory head drive method inevitably wastes ink. If the third nozzle drive method in which the nozzle is driven to such an extent as not to discharge ink and subsequently the nozzle is driven to discharge ink, is used, the disadvantages of the above two nozzle drive methods are removed. In the third nozzle drive method, the two nozzle drive operations are successively performed. When the head is preparatorily driven, particularly under low temperature conditions, the preparatory head drive using the pulse width not causing the nozzle to discharge ink generates an insufficient heat value. This results in a relatively long warm-up time to increase the head temperature up to a preset temperature at which a print-ready state is set up. In the case of the head having a large heat capacity, when the nozzle is driven to such a degree as to discharge ink, a considerable amount of time is taken until its temperature is increased to such an extent that the physical properties of the ink become stable. To cope with this, Japanese Patent Laid-Open Publication No. Hei. 4-44856 discloses a unique preparatory head drive method. In this method, the frequency of a nozzle drive signal used in the preparatory head drive operation is higher than that of a nozzle drive signal used in the normal print operation, in order to reduce a preparatory head drive time.

This preparatory head drive method succeeds in reducing the warm-up time. However, the heater current the head consumes per unit time necessarily increases. Accordingly, in some cases, the power source capacity must be increased. This leads to an increase in the cost to manufacture. This problem tends to occur particularly when a plurality of heads are concurrently driven in a preparatory mode. In a case where the power source capacity is not increased, the heater voltage drops. In this case, the reduction of the time of warming up the head sometimes fails. In a case where a plural number of heads are systematically combined, an approach where these heads are driven one by one is possible. However, this approach consumes the sum of the times to drive those heads for the preparatory head drive time. This approach also fails to reduce the preparatory head drive time. When the head is driven in low temperature conditions, the head temperature is increased by preparatorily driving the head while causing it to discharge ink. Accordingly, the number of ink discharging operations is increased, wasting ink.

In a case where the time the printer is not used is relatively short, and the print operation is performed in low temperature conditions, the print failure can be eliminated in a relatively simple manner, as mentioned above, that the head temperature is increased and ink is discharged. In a case where the printer is left unused for a long time, the viscosity of the ink remaining near the nozzle discharge openings becomes too high to cure the clogged openings of the nozzles. A conventional way to cure the clogged openings of the nozzles is to increase the number of preparatory head drive operations and to suck the high viscosity ink from the capped head nozzle with a pump. This measure also wastes considerable ink.

SUMMARY OF THE INVENTION

For the above background reasons, the object of the present invention is to provide an ink jet printer in which the preparatory head control including the cure of the clogged openings of the nozzles and the rise of the head temperature can be performed with less consumption of ink and at high speed even when the printer is left unused for a long time and operated in low temperature conditions.

To achieve the above object, the present invention according to a first aspect provides a preparatory head drive method for an ink jet printer having heads each including a plural number of nozzles, wherein a discharging, preparatory drive method for effecting the head temperature rise by driving the nozzles so as to discharge ink, and a heating, preparatory drive method for effecting the same by driving the nozzles to such an extent as not to discharge ink are alternately executed.

The present invention according to a second aspect provides a preparatory head drive method for an ink jet printer having heads each including a plural number of nozzles, those nozzles being grouped into nozzle blocks each consisting of a preset number of nozzles, the nozzles for every nozzle block being sequentially driven, for ink discharge with preset time lags, said method, wherein one nozzle drive control for all of the nozzle blocks includes a discharging, preparatory drive method for driving the nozzles so as to discharge ink every nozzle block, and a heating, preparatory drive method for driving the nozzles to such an extent as to not discharge ink.

The invention according to a third aspect provides the preparatory head drive method according to the first or second aspect, wherein the time interval between a discharging, preparatory drive and the next discharging, preparatory drive for each nozzle is longer than the time interval of the normal drive in a normal head drive mode, and the time interval between a heating, preparatory drive and the next heating, preparatory drive for each nozzle is shorter than the time interval of the normal drive in a normal head drive mode.

The present invention according to a fourth aspect provides a preparatory head drive method for an ink jet printer wherein when a head temperature is detected in the preparatory head drive mode and it is t (°C.), the head drive preparation is continued until the head temperature reaches a preset head temperature T(°C.) given by $$T=a\times t+b \text{ (°C.)}.$$

The present invention according to a fifth aspect provides the preparatory head drive method for an ink jet printer according to the fourth aspect, wherein the preset head temperature T(°C.) is $$T=0.5t+23 \text{ (°C.)}.$$

The present invention according to a sixth aspect provides the preparatory head drive method for an ink jet printer according to the fourth or fifth aspect, wherein the preparatory head drive method according to the first, second or third aspect is used for the preparatory head drive operation used in the preparatory head drive method according to the fourth or fifth aspect.

In the invention according to the first aspect, the discharging, preparatory drive method which consumes a large amount of ink but generates large heat value, and the heating, preparatory drive method which consumes less ink and generates a small heat value are alternately executed. This feature saves ink and provides a rapid head temperature rise.

In the invention according to the second aspect, during one nozzle drive control for all of the nozzle blocks, the discharging, preparatory drive method which consumes a large amount of ink but generates large heat value, and the heating, preparatory drive method which consumes less ink and generates a small heat value are carried out every nozzle block. This feature saves ink and provides a rapid head temperature rise.

In the invention according to the third aspect, the time interval between a discharging, preparatory drive and the next discharging, preparatory drive for each nozzle is longer than the time interval of the normal drive in a normal head drive mode, and the amount of the ink consumed per unit time may be reduced. Further, since the time interval between a heating, preparatory drive and the next heating, preparatory drive for each nozzle is shorter than the time interval of the normal drive in a normal head drive mode, the heat value generated by the head is increased, and a rapid head temperature rise is realized.

In the invention according to the fourth aspect, when a head temperature is detected in the preparatory head drive mode and it is t (°C.), the head drive preparation is continued until the head temperature reaches a preset head temperature T(°C.) given by $$T=a\cdot t+b(\text{°C.}).$$

With this feature, the viscosity of ink is reduced, thereby curing the clogged nozzles. Wasteful ink consumption is eliminated, and an effective clog removal operation is realized.

In the invention according to the fifth aspect, the preset head temperature T(°C.) is $$T=0.5t+23 \text{ (°C.)}.$$

When the head temperature rises up to this preset temperature, a more effective clog curing operation is achieved.

In the invention according to the sixth aspect, the preparatory head drive method according to the first, second or third aspect is used for the preparatory head drive operation used in the preparatory head drive method according to the fourth or fifth aspect. This feature secures an increase of the head heat value, a rapid head temperature rise, and a more effective clog curing operation.

BRIEF DESCRIPTION OF THE DRAWINGS

Other objects, advantages and features of the invention will be apparent when carefully reading the following detailed descriptions in connection with the accompanying drawings, in which.

DETAILED DESCRIPTION OF THE PREFERRED EMBODIMENT

Figure 1:
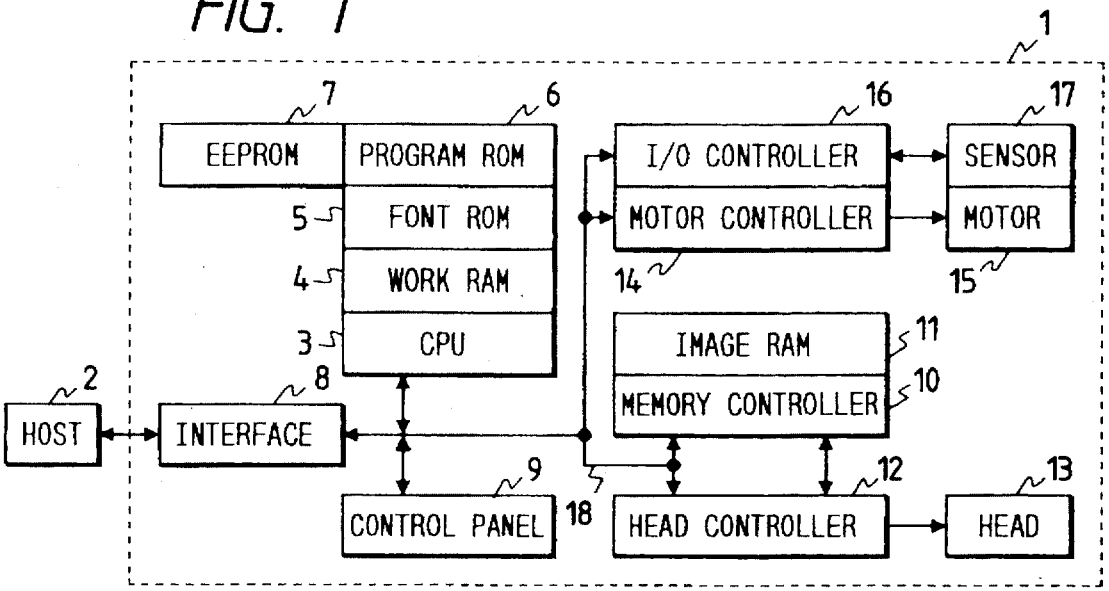
FIG. 1 is a block diagram showing the arrangement of a control system for an ink jet printer incorporating the present invention.

The arrangement of a control system for an ink jet print system incorporating the present invention is illustrated in block form in FIG. 1. In the figure, reference numeral 1 designates an ink jet printer; numeral 2, a host computer; 3, a CPU (central processing unit); 4, a work RAM; 5, a font ROM; 6, a program ROM; 7, an EEPROM; 8, an interface; 9, a control panel; 10, a memory controller; 11, an image RAM; 12, a head controller; 13, a print head unit; 14, a motor controller, 15, a motor; 16, an I/O controller; 17, sensors; and 18, a common bus.

The ink jet printer 1 is connected to the host computer 2. Various types of data are transferred between the printer and the host computer. The CPU 3 is connected to the work RAM 4, the font ROM 5, the program ROM 6, and the EEPROM 7. The CPU 3 operates according to the programs stored in the program ROM 6 while referring to set values, such as correction data for high picture quality, stored in the EEPROM 7. The CPU 3, connected to the common bus 18, controls the respective portions in the ink jet printer 1 by way of the common bus 18. The work RAM 4 is used as a work memory area for the CPU 3, and further for storing various types of data in the control system. The font ROM 5 stores data of characters to be printed, in the form of image data. The program ROM 6 stores programs for instructing the operations of the CPU 3. The EEPROM 7 is constructed with a volatile memory capable of retaining data therein when the power source is turned off. The EEPROM 7 is used for storing various set values, such as correction data for high picture quality and those for system operation modes. Sometimes those set values are set from the control panel 9.

The interface 8, connected to the common bus 18 and the host computer 2, directly transfers data to and from the host computer 3. The control panel 9, connected to the common bus 18, receives various instructions and data from a user and presents various status and messages to the user.

The memory controller 10 is connected to the image RAM 11, the common bus 18, and the head controller 12, and controls the image RAM 11. The image RAM 11 stores recorded or printed data in the form of image data. The memory area of the image RAM 11 may be segmented into memory areas for the respective print heads.

The head controller 12 is connected to the print head unit 13, the common bus 18, and the memory controller 10, and controls the print head unit 13. Specifically, the head controller 12 controls the timing of discharging ink from the nozzles of each print head of the print head unit, temperature of the ink, and the like. If required, the head controller 12 may select the nozzle or nozzles according to nozzle select data as will be described later, in lieu of the CPU 3. The print head unit 13 consists of a plural number of heads each having an N number of nozzles. In the case of a color printer, for example, the print head unit consists of four print heads of black K, cyan C, magenta M, and yellow Y.

The motor controller 14 for controlling the motor 15 is connected to the motor 15 and the common bus 18. The motor 15 causes relative motions of a carriage mounted on the print head unit 13 and recording medium, e.g., recording paper. The I/O controller 16 for controlling various types of sensors 17 and status data is connected to the sensors 17 and the common bus 18. Those sensors are provided to sense paper edges, paper width, the quantity of ink, and the like.

The common bus 18 for transferring various types of data and control signals is connected to the CPU 3, interface 8, control panel 9, memory controller 10, head controller 12, motor controller 14 and the I/O controller 16.

While in the above construction description the control system for the ink jet printer is functionally divided into the blocks, it is evident that the image RAM 11 and the work RAM 4 may be realized by a single RAM.

Figure 3:
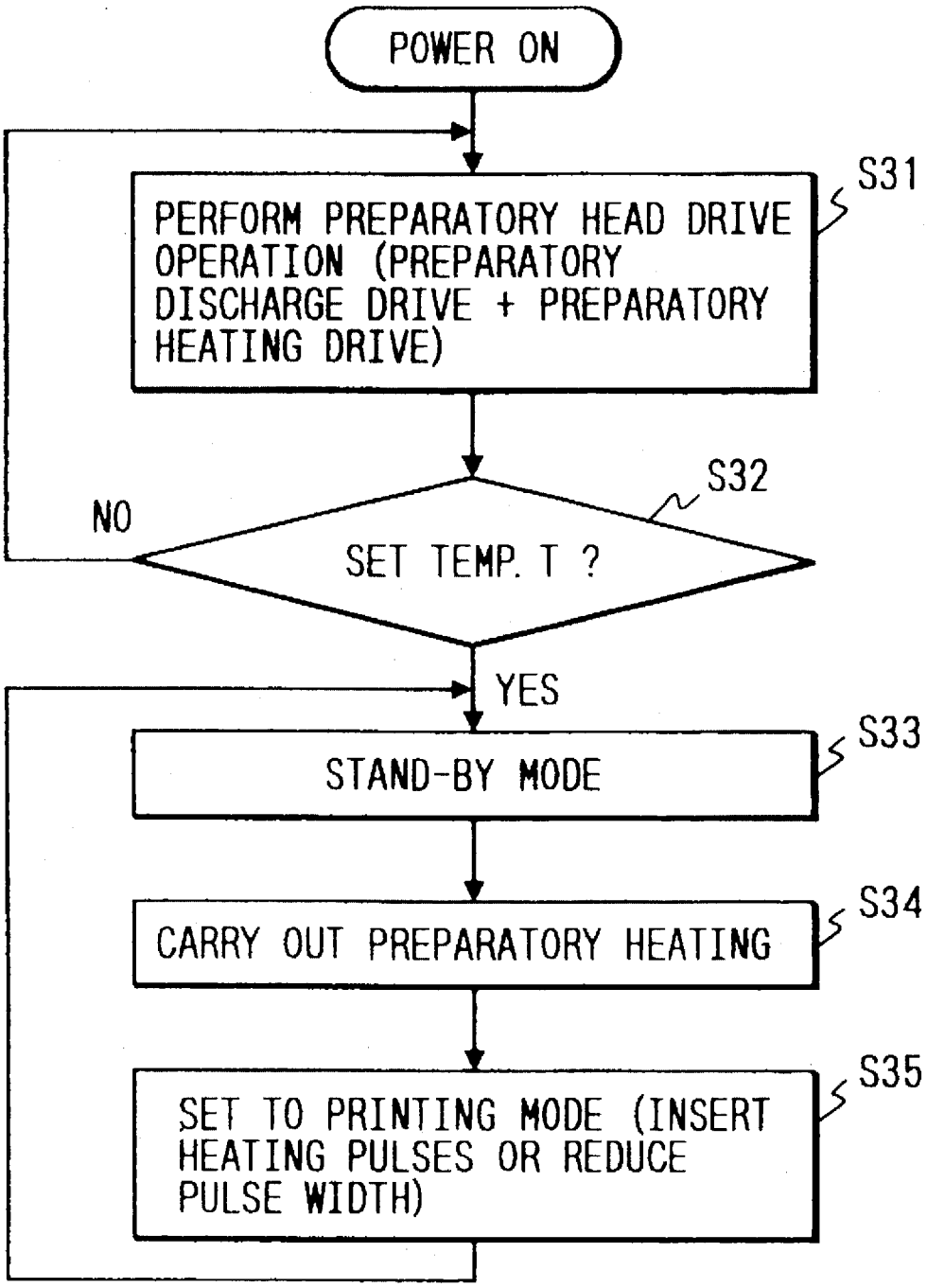
FIG. 3 is a flowchart showing an operation of the ink jet printer.

The operation of the above-described control system of the ink jet printer incorporating the present invention will be described with reference to FIGS. 1 and 3. The system operation described below includes preparatory head drive operations. A flowchart illustrated in FIG. 3 outlines the system operation of the control system of the ink jet printer as an embodiment of the present invention. Upon power on, the CPU 3 operates according to programs stored in the program ROM 6 while referring to set values and the like stored in the EEPROM 7. During operation, it uses the work RAM 4 as needed. The set values and the like stored in the EEPROM 7 are entered from the control panel 9.

When the power source of the control system is turned on, the print head unit is preparatorily driven in a step S31. The preparatory head drive operation consists of a preparatory discharge drive operation and a preparatory heating drive operation. In the preparatory discharge drive operation, the print head is driven to such a degree as to both discharge ink and to not discharge ink. The preparatory head drive operation is continued until a head temperature determined at the time of power on, typically a preset temperature T (°C.) set according to ambient temperature, is reached. To this end, the CPU 3 fetches temperature information of the head from the sensors 17, through the I/O controller 16. During the preparatory head drive operation, the CPU 3 monitors the head temperature and continues the preparatory head drive operation until the head temperature reaches the preset temperature T (°C.). In a step S32, the CPU detects the head temperature has reached the preset temperature T (°C.), and ends the preparatory head drive operation, and in a step S33 the CPU is placed in a stand-by mode. During the stand-by mode, the CPU or the system control, in a step S34, executes the preparatory head drive operation so as to keep the head temperature at least 20° C. Upon arrival of the data to be recorded, the system control advances to a step S35 where it is placed to a record mode.

When receiving the data to be recorded, such as image data and character data, from the host computer 2, the control system receives the data at the interface 8 and sends the received data to the CPU 3. The CPU 3 converts the received image data into image data that can be recorded, such as bit map data, in accordance with the print format. If, for example, the received data consists of character code, the CPU 3 converts the received data into the image data of the character while referring to the font ROM 5. The image data converted is stored into the image RAM 11 through the memory controller 10. The CPU 3 fetches information from the sensors 17 through the I/O controller 16, checks if the received information can be recorded, gives instructions regarding carriage movement, paper transport, and the like to the motor controller 14, thereby positioning for print. When the image data is stored, the CPU 3 determines the width of the head drive pulse and a head drive mode on the basis of the temperature sensing elements that are contained in the printer body and the heads, and sets various preset values in the head controller 12. Particularly immediately before printing and when the head temperature is low or the heads are left unused for a long time, the heads temperature is raised up to an optimum temperature region where the ink discharge characteristics of the heads are relatively stable, otherwise the heads must be operated under poor ink discharge conditions. In other words, the CPU 3 executes the preparatory head drive operation to remove the clogging state of the heads. Then, the CPU 3 requests the motor controller 14 to move the carriage for scanning operation. The carriage having the print head unit 13 mounted thereon is provided with an encoder for generating print timings. The data representative of the print timings based on the scan speed of the carriage are input to the CPU 3 and the head controller 12. The CPU 3 determines the print start position according to the print timing data received, and supplies a gate signal for print permission to the head controller 12. The print permission gate signal and the print timing signal cause the head controller 12 to output the head drive signal for transfer to the print head unit 13. When this operation is successively performed and the print of one scan is completed, the memory controller 10 produces an interrupt signal for transfer to the CPU 3. Upon receipt of the interrupt signal, the CPU 3 requests the motor controller 14 to transport the recording or print medium by a distance of the print record width and to rescan by the carriage. In this way, the one-scan print is carried out plural times until the print operation in the direction of transporting the print media is completed. In this way, the print operation for one sheet of print medium is completed. Then, the CPU 3 requests the motor controller 14 to discharge the printed print medium out of the printer. If the data to be printed is still present, the CPU 3 requests another transport of a new print medium and continues the print mode.

Also in this print mode, the CPU 3 detects temperature of the heads and the like for temperature monitoring, and keeps the head temperatures within the temperature range of approximately 20° C. to 40° C. so as to prevent excessive temperature drop or rise. To accomplish this, the CPU 3 inserts heating pulses or reduces the pulse width.

Upon completion of the print operation, the CPU 3 requests the motor controller 14 to discharge the print medium, while at the same time moving the carriage up to the position where the cap mechanism covering the nozzles is present and performs the capping operation. Then, it returns to a step S33 and waits for the next print operation. During the waiting, the CPU 3 preliminarily heats the heads in a step S34, and waits for the incoming, next print data.

Figure 2:
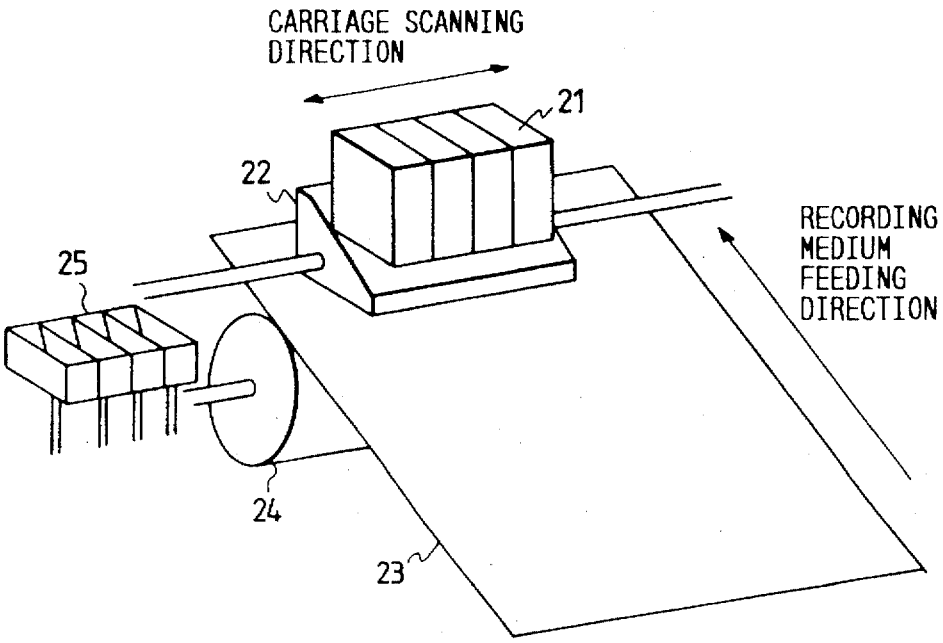
FIG. 2 is a schematic view showing a carriage and components disposed near the carriage in the ink jet printer.

FIG. 2 is a perspective view schematically showing a carriage and components disposed near the carriage in the ink jet printer. In the figure, reference numeral 21 designates a recording head unit; 22, a carriage; 23, a recording or print medium; 24, a transport roller; and 25, a cap mechanism. A single or a plural number of recording head units 21 are mounted on the carriage 22. The print head units 21, if a plural number of print head units are used, are mounted thereon individually or in a one-piece construction. The print head unit 21 includes a plural number of nozzles. In a non-print mode, the print head unit 21 is located at the position of the cap mechanism 25 where the cap mechanism prevents the drying of the ink in the heads. At the position of the cap mechanism 25, ink is discharged as the result of the preparatory head drive operation. A structure for receiving the discharged ink may be provided in the cap mechanism 25. In a print mode, the nozzles discharge ink for print while the carriage is reciprocatively moved. In a printer where a plural number of print head units 21 are mounted on the carriage, the print head units 21 discharge inks to progressively form an image in a manner that the dots by the discharged inks are superimposed on one another. When the print medium is under transportation or the print medium is positioned for printing according to a preset format, the medium may be transported in accordance with instructions issued from the CPU 3. Further, a quantity of the forward movement or transportation may be adjusted according to instructions from the CPU 3.

Figure 4:
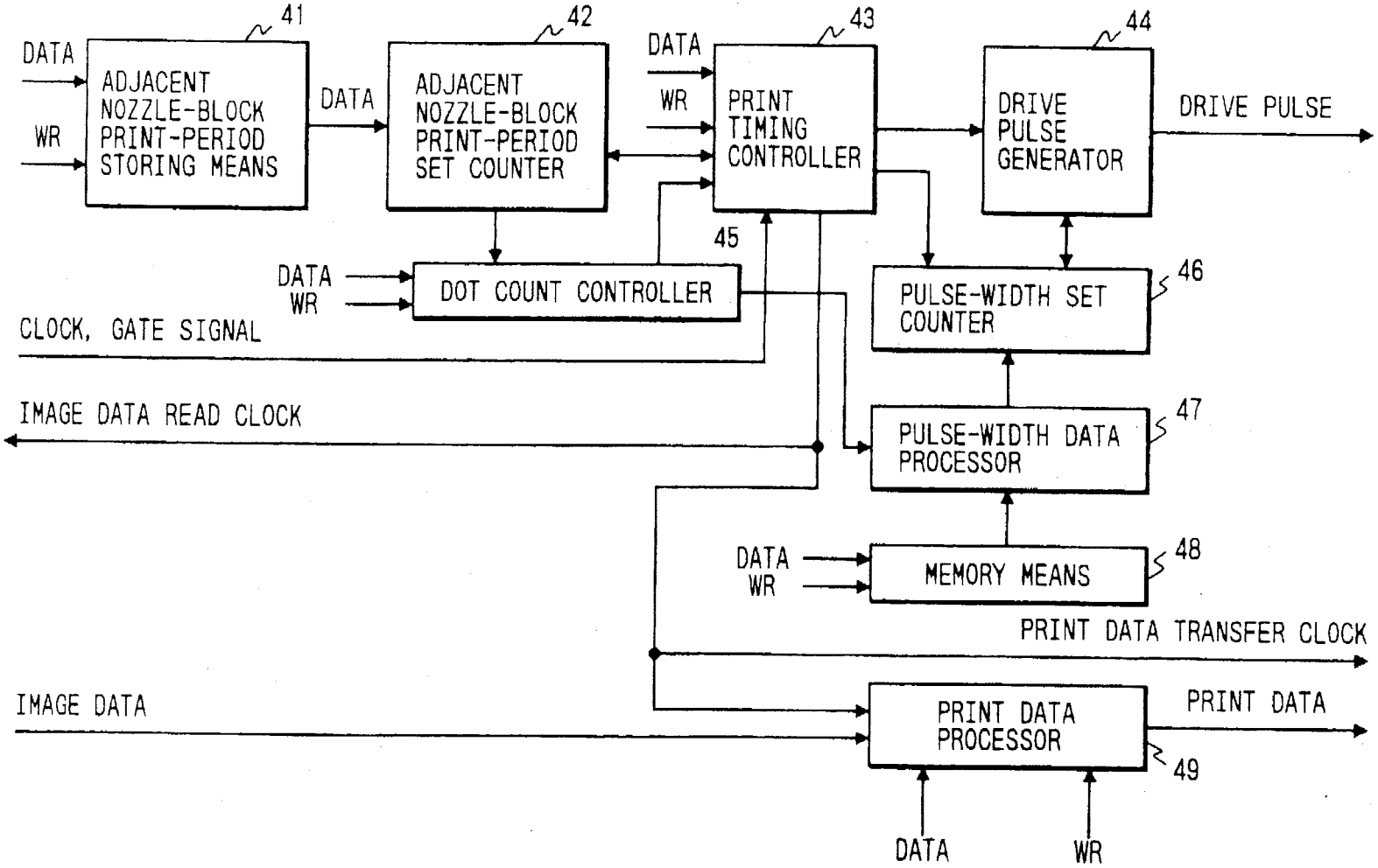
FIG. 4 is a block diagram showing an arrangement of a head drive controls section in the ink jet printer.

FIG. 4 is a block diagram showing an arrangement of a head drive control section in the ink jet printer. In the figure, reference numeral 41 designates an adjacent nozzle-block print-period storing means; 42, an adjacent nozzle-block print-period set counter; 43, a print timing controller; 44, a drive pulse generator; 45, a dot count controller; 46, a pulse-width set counter; 47, a pulse-width data processor; 48, a memory means; and 49, a print data processor. The head drive control section constitutes a part of the head controller 12. The control of a single head will be described, but the same is correspondingly applied to the control of a plural number of heads. To drive the nozzles of each head, the nozzles are grouped into several nozzle blocks. The nozzles of each block are simultaneously driven, and the nozzle blocks are sequentially driven. In the present specification, the nozzle block will be frequently referred to as a simultaneously-driven nozzle block.

The adjacent nozzle block print-period storing means 41 stores adjacent nozzle-block print period values each corresponding to the time duration between the time points where the adjacent nozzle-blocks are driven. The data representative of the print period values, which come from the CPU 3 and the like, are stored into the adjacent nozzle-block print period storing means in response to the signal WR. The adjacent nozzle-block print-period set counter 42 generates a print period signal representative of the time duration between the time points where the adjacent nozzle-blocks are driven, according to an instruction by the print timing controller 43, and transfers the generated signal to the print timing controller 43 and the dot count controller 45. The dot count controller 45 receives the print period signal from the adjacent nozzle-block print-period set counter 42, and counts the number of nozzle blocks. When the count reaches the total number of nozzles, the dot count controller 45 sends a signal representative of the count of the total number of nozzles to the print timing controller 43. A memory means, which is contained in the dot count controller 45, stores the data on the process of the drive pulse width, which is carried out in the pulse-width data processor 47 and is applied to the nozzle blocks. The data is derived from the CPU 3 and the like and stored in the memory means in response to a signal WR.

The print timing controller 43 generates various timing signals. The print timing controller 43 receives a clock signal and a gate signal from another control section, a print period signal from the adjacent nozzle-block print-period set counter 42, a signal representative of the number of nozzle blocks from the dot count controller 45, and supplies a count fetch instruction and a count clock signal to the adjacent nozzle-block print-period set counter 42 and the pulse-width set counter 46, and sends a drive start instruction to the drive pulse generator 44. Further, the print timing controller 43 supplies a print data transfer clock signal to the print data processor 49, and supplies the same signal to the print head and the memory controller 10 shown in FIG. 1. The same further directly receives data line for requesting a print drive operation and a signal WR from the CPU 3 and the like, for the purpose of preparatorily driving the head.

The drive pulse generator 44 receives a drive start instruction from the print timing controller 43 and a count end signal from the pulse-width set counter 46, whereby controlling the on/off control of the drive pulse to the print head. The pulse-width set counter 46 fetches the drive pulse width data that is processed by the pulse-width data processor 47, and continues to count according to the count clock signal from the print timing controller 43 till the count reaches the drive pulse width data, and supplies an end signal to the drive pulse generator 44. According to the data from the dot count controller 45, the pulse-width data processor 47 processes the drive pulse width data that is stored in the memory means 48. In an example where the optimum drive pulse width data for the ink discharge is set in the memory means 48, the pulse-width data processor 47 processes the drive pulse width into the drive pulse width for prohibiting the ink discharge. The memory means 48 stores the drive pulse data to be set in the pulse-width set counter 46. This data is derived from the CPU 3 and the like and set therein by the signal WR.

The image data supplied externally is read out of the image RAM 11 in accordance with an image data read clock signal from the print timing controller 43, and transfers print data to the head in accordance with a print data transfer clock signal that is the same as the image data read clock signal. In the print data processor 49, thee print data at the time of the preparatory head drive operation is prepared. As for the print data prepared by the print data processor 49, the print data to given nozzles is selectively set regardless of the image data. The data of the number of nozzles and the nozzle positions are derived from the CPU 3 and the like, and are stored by the signal WR.

The head drive control in a print mode will be described. In this mode, the temperature of the head has been controlled to be within an optimum temperature range by the preparatory head drive operation. Accordingly, the print data processor 49 is inhibited from preparing the print data since the present head temperature is within the optimum temperature range.

When the data to be printed is set in the image RAM 11 shown in FIG. 1, the temperature sensing means senses the present head temperature, and the print drive pulse width data S best suited for the sensed temperature is set in the memory means 48.

When receiving a print gate signal and a print timing signal (clock signal) from the exterior, the print timing controller 43 generates a signal to set the adjacent nozzle-block print period value Sp (second). that is stored in the adjacent nozzle block print period storing means 41, in the adjacent nozzle block print-period set counter 42. This signal is also used for setting the drive pulse width data in the pulse-width set counter 46.

At the instant that a count clock signal is input from the print timing controller 43 to the adjacent nozzle-block print-period set counter 42 and the pulse-width set counter 46, the print drive pulse output from the drive pulse generator 44 goes high (H level), so that current starts to flow into the head. After the count by the pulse-width set counter 46 reaches a value corresponding to the drive pulse width data that is set, an end signal is applied to the drive pulse generator 44, so that the print drive pulse goes low (L level). At this point, the operation of feeding current to the head heater is complete. The result of such an operation is to form a print drive pulse of S second. Within this period of S second, the head heater is heated, bubbles are generated within the nozzles, and ink is discharged or shot forth. Then, after the adjacent nozzle-block print-period set counter 42 counts a value corresponding to the adjacent nozzle-block print period value Sp (second) that is set, it judges that the print control for one nozzle block of which the nozzles are simultaneously driven has been completed. Based on this judgement, it generates one clock for transfer to the dot count controller 45, and controls the present number of print dots. Further, it sends an end signal to the print timing controller 43.

Upon receipt of the end signal from the adjacent nozzle-block print-period set counter 42, the print timing controller 43 generates a signal for the next print start, and repeats the above operations. When the value of the dot count controller 45 indicates the count of the total number of nozzles, it inhibits the print timing controller 43 from generating the next print start signal. Through the sequence of operations, the nozzles are all driven. The print drive pulses are output through such sequential operations. The number of those generated pulses is equal to the number of nozzle blocks to be driven, the pulse width is S second, and the time interval of pulse generation is Sp second. The ink streams are shot forth, thereby forming an image. The sequence of operations is successively performed for the number of times corresponding to the scan print width of the print medium. Further, the print medium is transported by a distance corresponding to the nozzle width. The above operations are further repeated, thereby completing the print operation on a single sheet of print medium.

Figure 11:
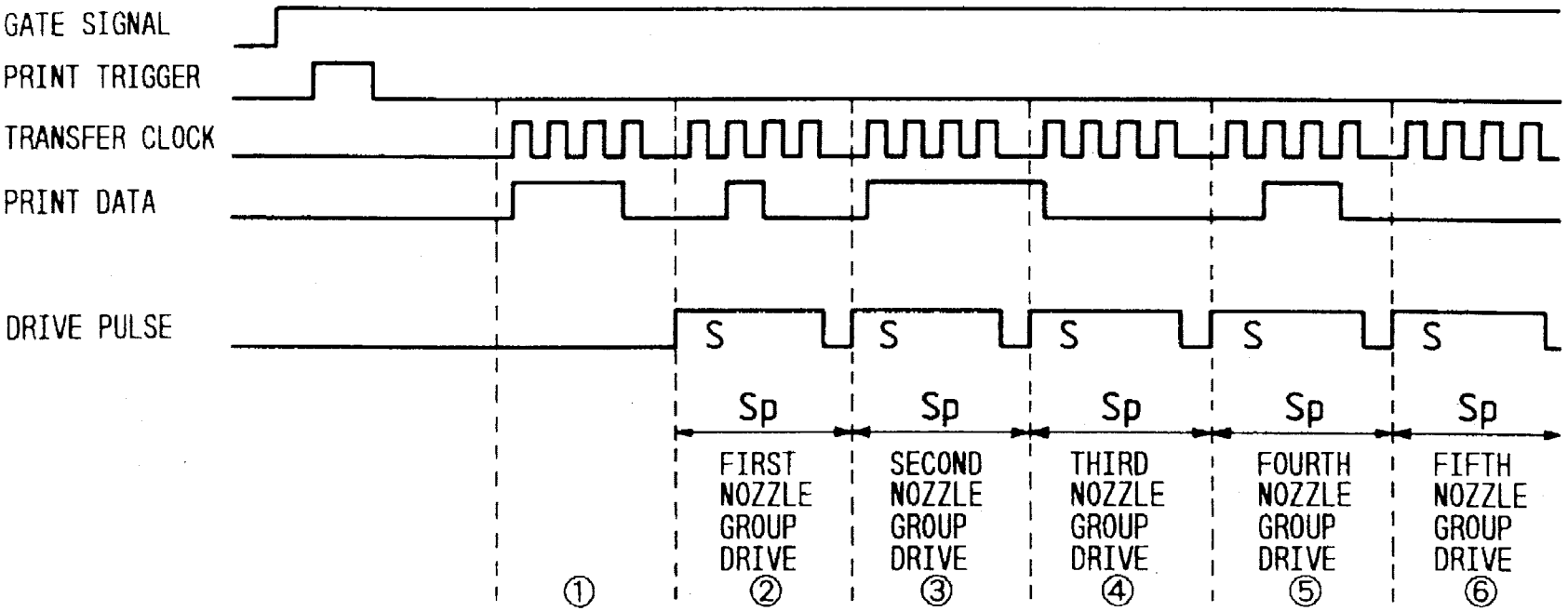
FIG. 11 is a timing chart showing the operation of a head drive control section when the ink jet printer operates in a normal print mode.

FIG. 11 is a timing chart showing the operation of a head drive control section when the head temperature is within the optimum temperature range. As shown, the gate signal goes high and subsequently a print trigger is applied. Then, the print timing controller 43 outputs an image data read clock signal to the memory controller 10. The memory controller 10 outputs image data in unison with the image data read clock signal. The image data is transferred through the print data processor 49 to the heads. In unison with a print transfer clock signal that is the same as the image data read clock signal, at the trailing edge thereof the image data is loaded into and retained in the registers of the heads. In accordance with the drive pulse signal output from the drive pulse generator 44, current is fed to the heaters of the nozzles to be driven for print. The number of nozzles to be simultaneously driven in this embodiment is four (4). Application of the drive pulse signal is timed after the 4-bit print data is transferred to the registers of the heads. In a case where the total number of the simultaneously driven nozzles is 128, the every-4-bit control is repeated 32 times.

For the first nozzle block, in a state (1), print data is transferred to the head through the print data processor 49, and in a state (2) an actual printing operation is carried out by shooting forth ink streams.

As described above, before the actual print operation, the head is preparatorily driven in order to prevent print failure and nondischarge of ink. Before proceeding with the operation of the preparatory head drive, factors for head drive control will first be described.

As already stated, when the ink jet printer is operated in low temperature conditions and left unused for a long time, the physical properties of the ink, its viscosity is remarkably increased. Under this condition, a smooth discharge of ink is impossible because of the clogging of nozzles. In order to cure the clogged openings of the nozzles, which ensues from the increased viscosity, several control factors were selected and experiments on those factors were conducted. These experiments were conducted according to the experimental design method. The experimental design method methodologically handles the layout of experiments and the analysis of the results of the experiments in order to effectively obtain the effects of various control factors. In the experiments, the print frequency, heater voltage, nozzle drive pulse width, presence or absence of the head temperature rise, and head variance were selected for the control factors for controlling the operation of recovering the head nozzles from their clogged state. In the experiments based on the combination of those control factors, the repeated experiments were performed according to the L8 orthogonal table. The number of ink discharging actions necessary for gaining a normal print was checked every factor combination experiment. It is safe to say that a smaller number of ink discharging actions implies that the factor combination includes the effective control factors. In the experiments, the nozzles were perfectly opened and left open for a given time in order to clog the nozzles before the combinations are driven. After the time that the nozzles were left open, errors among the repeated experiments become large by varying ambient conditions, such as temperature, humidity, air flow, and the like. As a result, the effects of the control factors contain errors. To cope with this, a maximum left-stand time that is reproducible was investigated among the repeated experiments. The maximum left-stand time Ft (hour) was used as the left-stand time.

The factor effect indicative of a degree of the effect of each control factor was charted against the overall effects, using the results of the experiments. From the numerical analysis of those results, it was confirmed that the five control factors are significant, that is, those factors contribute to the curing action of the nozzle clogging in some way. Among those factors, the head variance is significant, but its contribution to the clog curing action is very small. Accordingly, a scatter occurs in the number of ink discharging actions to cure the clogged nozzles, but it is negligible.

Inks of black, cyan, magenta and yellow were used in these experiments. The fact that the control factors efficacious for all of those color inks in curing the clogged nozzles are the drive frequency and the head temperature rise that is performed before the clog curing operation was confirmed. The increase of the nozzle drive pulse width and the increase of the heater voltage are also efficacious to a certain degree, but are accompanied by disadvantages. The increase of the drive pulse width leads to deterioration of the ink discharging performance. The increase of the heater voltage requires providing a means to vary the heater voltage, leading to increase of cost to manufacture. For this reason, it is suggested to use the two control factors as those set in the normal print drive conditions.

Characteristic values efficacious in curing the clogged nozzles were investigated, under the combination of the two control factors, the drive frequency and the head temperature rise that is performed before the clog curing operation. The results were as follows. When the head temperature rise value exceeds a certain value, the number of ink discharging actions may be reduced to zero (0) irrespective of the drive frequency. When the temperature rise value is relatively small, the number of ink discharging actions varies depending on the value of the drive frequency. The fact that when the head drive frequency is somewhat lower than the drive frequency in the normal print drive conditions, the number of ink discharging actions required till the clogged state of the nozzle is removed is reduced, was confirmed. From the experimental results, it is concluded that a preferable drive frequency at the time of the preparatory discharge of ink is a drive frequency F' (kHz) lower than the drive frequency F (kHz) in the normal print drive conditions.

Figure 5:
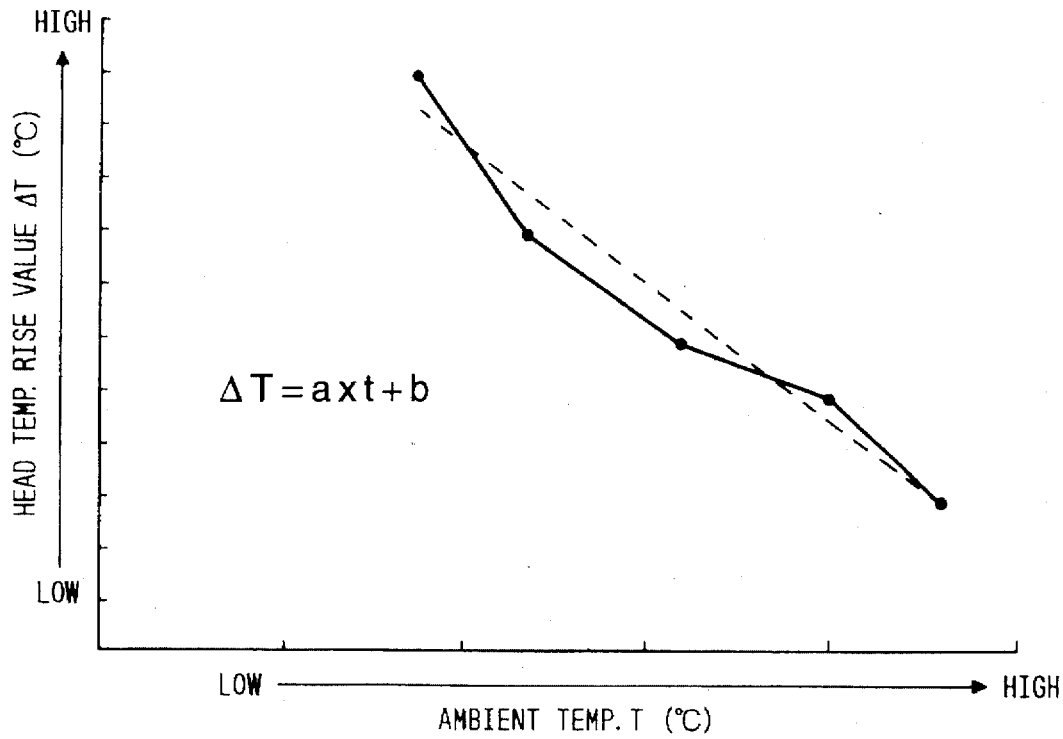
FIG. 5 is a graphical representation of the relationship between ambient temperature and the optimum temperature rise value of the head.
Figure 6:
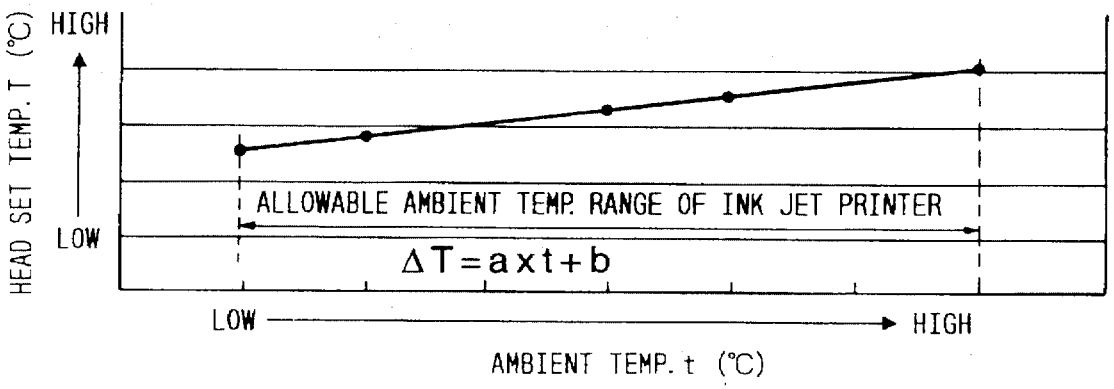
FIG. 6 is a graphical representation of the relationship between a head set temperature and ambient temperature.

The smallest possible temperature rise required for providing an easy-discharge of ink was investigated. FIG. 5 is a graphical representation of the relationship between ambient temperature and the optimum temperature rise value of the head. FIG. 6 is a graphical representation of the relationship between a head set temperature and ambient temperature. A continuous line in FIG. 5 indicates a head temperature rise value was required when the head is left standing at a certain ambient temperature for a time Ft (hour). As seen, as the ambient temperature becomes larger, the required head temperature rise is smaller. From the graph, the head temperature rise ΔT (°C.) can be given by the following linear approximate expression (graphically indicated by a dotted line)

$$\Delta T = -a' \cdot t + b' \quad (1)$$

A head temperature T (°C.) is expressed by $$T = t + \Delta T = a \cdot t + b \text{ (°C.)} \quad (2)$$

where t=an ambient temperature within a tolerable temperature range of the ink jet printer. This relationship is illustrated in FIG. 6. Thus, the relationship between the ambient temperature and the head set temperature can be expressed by a linear approximate equation.

In the experiment where the head is left standing for a time Ft (hour) in a state that the nozzles remains perfectly open, when the head temperature is raised according to the equation (2), the viscosity of the ink staying near the nozzle openings may be reduced. In other words, the ink can be normally discharged from the initial stage. Actually, because of evaporation of the moisture and volatile component that are contained in the ink, a color density of ink discharged at the initial stage of print is high. To avoid this, it is required to discharge ink approximately several times, perhaps as high ten times. When ink is discharged in the normal print drive conditions without the head temperature rise control based on the equation (2), preparatory discharge controls of approximately several hundreds, although depending on the ambient temperature, are required for curing all of the clogged nozzles. Comparison of those figures expressly show that the head temperature rise control based on the equation (2) considerably reduces the amount of ink consumption.

Another experiment for curing the clogged nozzles was conducted. In this experiment, the head was left standing for a long time in a state that the nozzle part of the head was covered with an airtight cap. It was confirmed that in the experiment, the left-standing time Ft (hour) corresponds to the number of days Ct (day) that the nozzle part is left while covered with the cap. That is, in an actual ink jet printer, within the idle time within the number of left-capped days Cal (day), the head could normally discharge ink from the initial stage of ink discharge by the equation (2) basis temperature rise. When the head is left standing for the number of days Ct (day) greatly exceeding the number of the capped days Cal (day), the equation (2) basis head temperature rise was insufficient for securing the normal ink discharge. However, the clogged nozzles could be cured after only several hundred ink discharging actions. In the case of the number of days, Ct (day), several thousand preparatory discharging actions were required for curing the clogged state of the nozzles when the equation (2) head temperature rise was not employed. Accordingly, the fact that the equation (2) basis head temperature rise is significant when the head is left standing while its nozzles are capped, was confirmed.

The following drive procedure for curing the clogged nozzles, which requires a reduced number of ink discharging actions, can be concluded from the results of the experiments as mentioned above.

As a step 1, the head temperature is raised. More specifically, the head is driven under the condition that the pulse width of the drive pulse is the pulse width t' (second) capable of discharging no ink, and the drive frequency F (kHz) is equal to the print frequency. The head set temperature is obtained using the equation (2)

$$T=a\cdot t+b \text{ (°C.)}.$$

The head temperature is raised up to the temperature obtained, thereby decreasing the viscosity of the ink staying near the nozzles openings.

In a step 2, the ink discharge control is performed. Specifically, the preparatory head drive operation is repeated in a manner that the head is driven at the drive frequency F' (kHz) according to the necessary number of ink discharging actions, which corresponds to the number of left-standing days, thereby causing all of the nozzles to discharge ink. The number of ink discharging actions is considerably smaller than the number of ink discharging actions when the clogged nozzle cure is based on only the ink discharging operation.

In the step 1, where the ink jet printer is located in a low temperature condition, if the head is driven by the drive pulses with the pulse width t' (second), much time is consumed for the head temperature rise. The reason for this is that since the drive pulse width used in the step 1 is small, the heat value by the drive pulse is small and hence the head temperature rise is gentle. The head temperature can quickly be raised by increasing the drive frequency and the duty ratio of the consumed current. However, in this case, the current supply capability of the power source must be increased, leading to increase of cost. To avoid this, for the preparatory head drive control, the present invention uses these control factors experimentally proved to be effective, thereby realizing a rapid head temperature rise in the low temperature conditions. As a result, the present invention succeeds in reducing the amount of ink used for curing the clogged nozzles.

The operation of the preparatory head drive will be described. To start with, the CPU 3 in FIG. 1 sets up a preparatory head drive mode.

Figure 7:
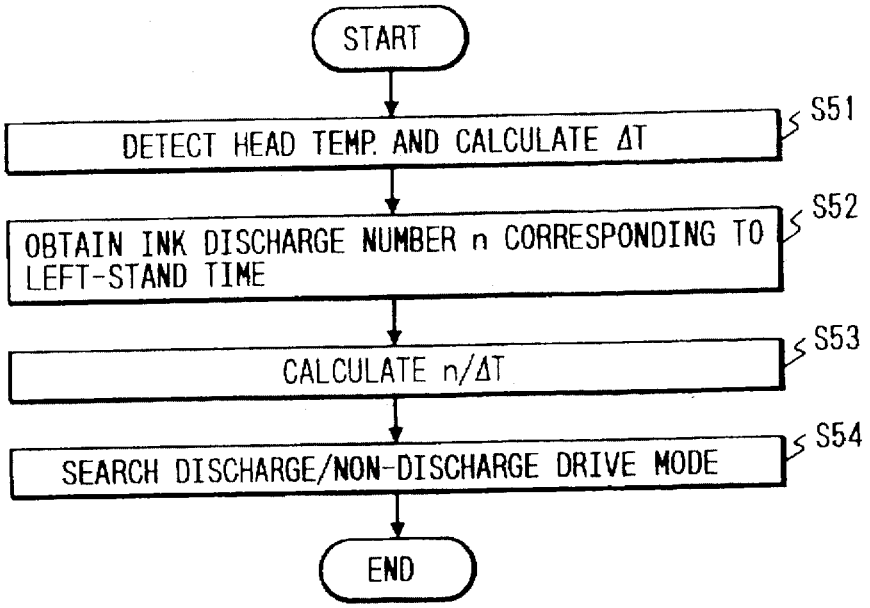
FIG. 7 is a flowchart showing a process for setting up preparatory head drive conditions for curing the clogged nozzles of the heads in the ink jet printer.

FIG. 7 is a flowchart showing a process for setting up preparatory head drive conditions for curing the clogged nozzles of the heads in the ink jet printer.

In a step S51, the current temperature of the heads is sensed, and the CPU calculates a necessary temperature rise ΔT (°C.) by using the equation (1). In a step S52, the CPU checks the left-standing time, and reads from the program ROM 6 shown in FIG. 1 the number n of ink discharging actions per nozzle, which is required for curing the clogged nozzle openings. The number of ink discharging actions, which is used in the drive procedure (steps 1 and 2) for reducing the amount of ink consumption as referred to above, is set to a value somewhat larger than a preset value since in the preparatory head drive method to be given hereinafter, ink is discharged while raising the head temperature. The check of the left-standing time may be realized by using a known clocking function, such as a timer function and a calendar function. In this case, the last date in using the ink jet printer is preferably stored in the EEPROM 7, for example, in FIG. 1.

Since all of the nozzles discharge ink n times during the process of raising the head temperature by the temperature rise ΔT (°C.), the number of ink discharging actions per nozzle when the head temperature is raised by 1° C. is calculated in step S53. In step S54, the CPU retrieves nozzle drive modes to discharge ink and not to discharge ink from the data table in the program ROM 6. As the result of the retrieval, a preparatory head drive mode is set up. The head is preparatorily driven in this mode the number of preparatory drive times obtained in the step S52.

The nozzle drive modes retrieved in step S54 will be described.

Figure 8:
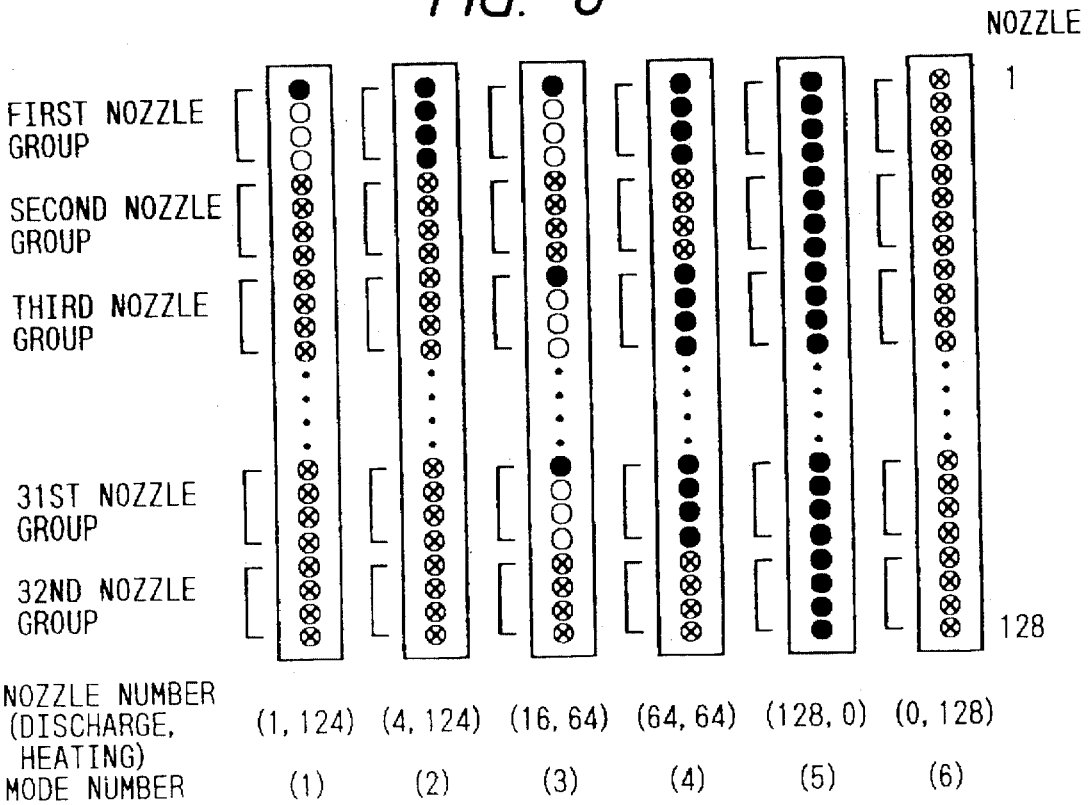
FIG. 8 is a diagram showing nozzle drive modes used when the ink jet printer is in the preparatory head drive mode.

FIG. 8 is a diagram exemplarily showing nozzle drive modes used when the ink jet printer is in the preparatory head drive mode.

In the illustration of FIG. 8, 128 nozzles are used. These nozzles are designated as a first nozzle, a second nozzle, a third nozzle, . . . , a 128th nozzle from top to bottom. The nozzles are grouped into first to 32nd nozzle blocks each consisting of four nozzles. The nozzles marked with circular black dots are those to discharge ink; the nozzles marked with circles are those not driven; and the nozzles marked with circles containing "x" therein are those driven for heating to such an extent as not to discharge ink.

Figure 12:
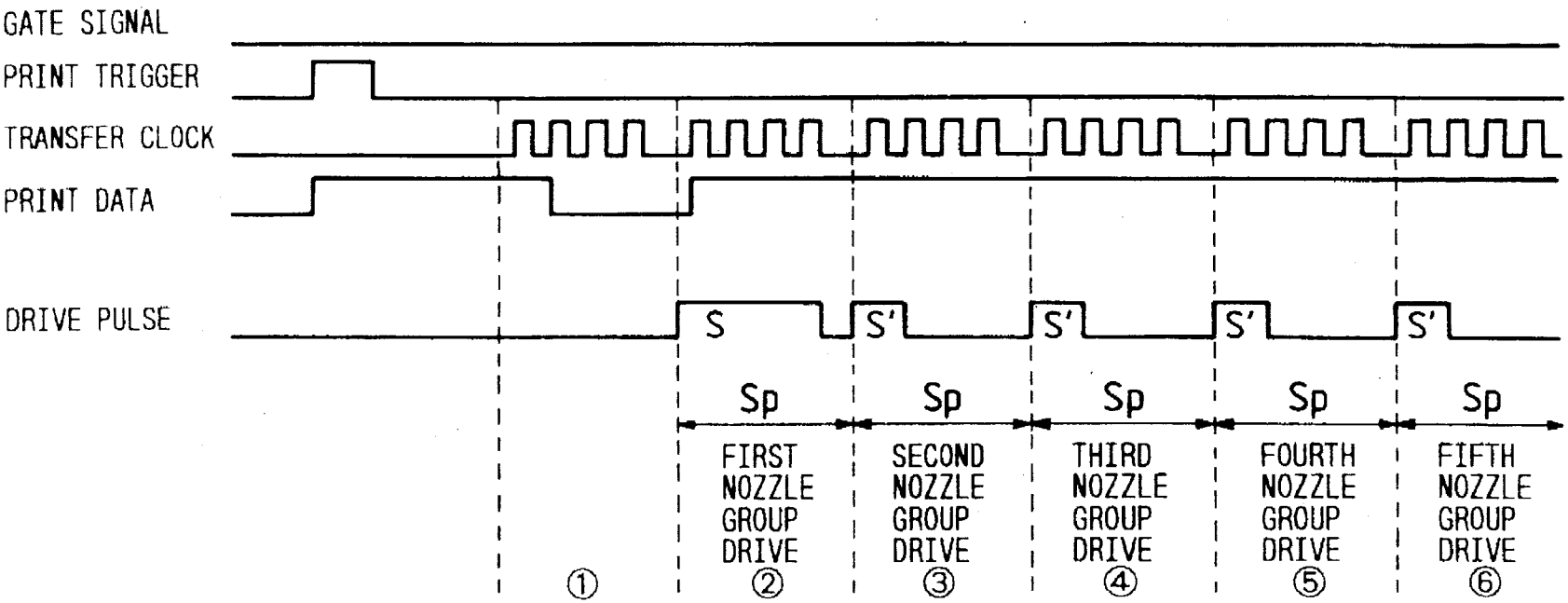
FIGS. 12 and 13 are timing charts showing the operations of the head drive control section when the ink jet printer operates in a preparatory head drive mode.
Figure 13:
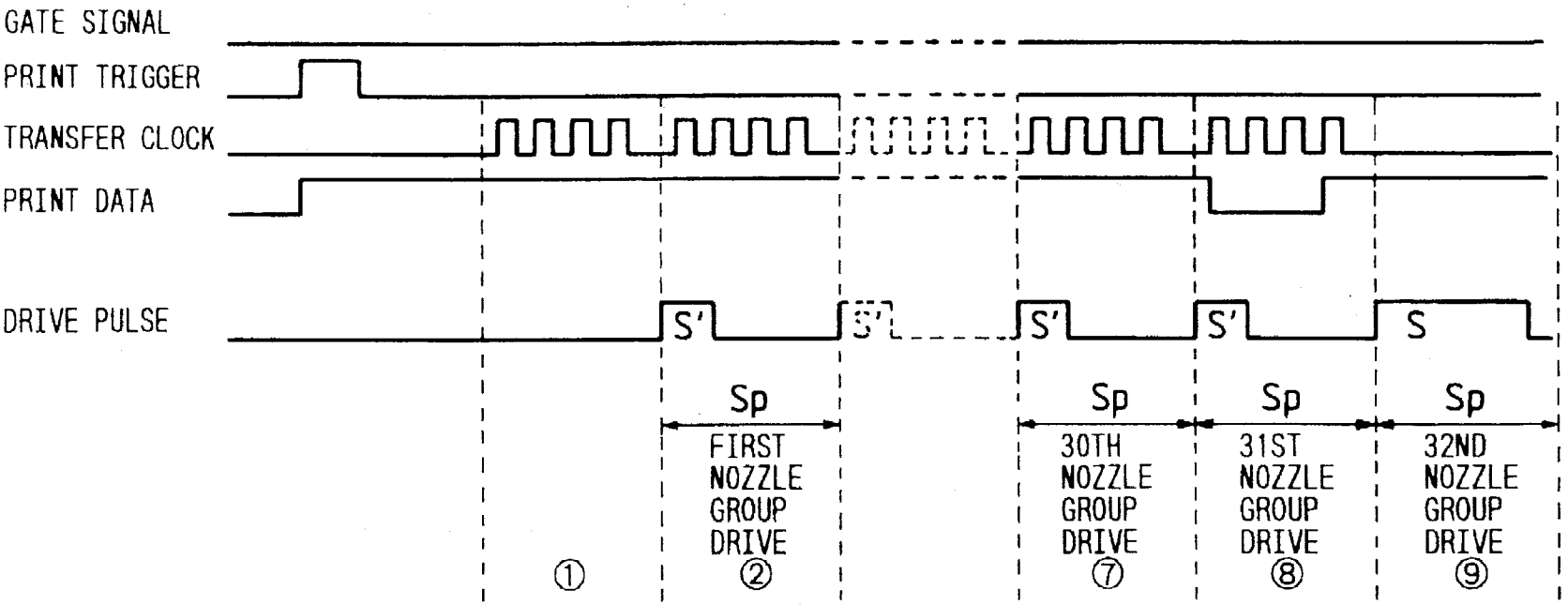

In the nozzle drive mode (1), one nozzle discharges ink, while 124 nozzles are driven to such a degree as to not discharge ink. As described above, the print head is driven every. FIGS. 12 and 13 are timing charts showing the operations of the head drive control section when the ink jet printer operates in a preparatory head drive mode, particularly in the nozzle drive mode (1). FIG. 12 shows a timing chart showing the operation of the head drive control section when the first nozzle is driven to discharge ink. In a state (1)

of FIG. 1, the print data processor 49 shown in FIG. 4 transfers such print data as to drive only the first nozzle to the head by the transfer clock. In state (2), the first nozzle block is driven by a drive pulse signal of the pulse width S (second). The print head is driven in such a way that current is fed to only the nozzle having received the print data of those nozzles of the driven nozzle group during the drive pulse width, thereby heating the heater. More specifically, in the first nozzle block, current is fed to the first nozzle for the time of S second, to heat the heater. As a result, only the first nozzle is driven to discharge ink, while the remaining three nozzles are not driven. The energy consumed in the head is the energy required for driving one nozzle to discharge ink.

In the second nozzle block, in state (2), such print data as to drive four nozzles is transferred to the head. In state (3), the head is driven by a drive pulse signal of such a pulse width S' (second) as not to discharge ink. That is, current is fed to the four nozzles for S' second, to heat the heaters. The heating of the heaters during the time of S' second fail to generate bubbles on the heaters, so that ink is not discharged from the nozzles. In this case, all of the four nozzles have the print data received, and are driven during the pulse width S' (second). Accordingly, the four nozzles consume such an amount of energy as not to discharge ink. Subsequently, a similar nozzle drive control is also applied to the third nozzle blocks. In this way, one nozzle drive control for all of the nozzle blocks consumes the sum of the energy to drive one nozzle to discharge ink and the energy to drive 124 nozzles to such an extent as not to discharge ink.

The operation of driving all of the nozzle blocks is repeated while switching the nozzles discharging ink. For example, in the second drive for all of the nozzle blocks, the second nozzle is driven to discharge ink. In the third drive, the third nozzle is driven to discharge ink, and in the 128th drive, the 128th nozzle is driven to discharge ink. FIG. 13 is a timing chart showing the operation of the head drive control section when the 128th nozzle is driven. In the first nozzle block, in state (1), such print data as to drive four nozzles is transferred to the head. In state (2), the head is driven by a drive pulse signal of such a pulse width S' (second) as not to discharge ink. The energy to drive to such an extent that the four nozzles fail to discharge ink is consumed. Subsequently, the nondischarge drive is continuously applied to the nozzle blocks up to the 31st nozzle block. In the 32nd nozzle block, in state (8), such print data as to drive only the fourth nozzle of the 32nd nozzle block, viz., the 128th nozzle, is transferred to the head. In state (9), the head is driven by a drive pulse signal of the pulse width S (second) wide enough to discharge ink, so the 128th nozzle discharges ink. The remaining nozzles in the 32nd nozzle block are not driven since they have no print data. At this time, the energy for driving one nozzle, or the 128th nozzle, to discharge ink is consumed. That is, as the result of the 128th drive control for all the nozzle blocks, the sum of the energy for driving one nozzle to discharge ink and the energy for driving 124 nozzles to such an extent as not to discharge ink, is consumed. Through the 128 drive controls for all the nozzle blocks, each nozzle is driven one time to discharge ink. This sequence of operations is repeated till the head temperature reaches a preset temperature T (°C.). The frequency at which one nozzle is driven for ink discharge is 1/128 as high as the frequency at which all the nozzle blocks are driven in the preparatory head drive mode.

In the description as given above, all the nozzle blocks are repeatedly driven while sequentially switching the nozzle to be driven for ink discharge from the first nozzle to the 128th nozzle. In this case, the nozzle to be driven for ink discharge and the nozzle not to be driven for ink discharge but heated may be selected as desired. For example, all of the nozzle blocks may be repeatedly driven in such an order that in the first drive control for all of the nozzle blocks, the first nozzle is driven to discharge ink, in the second drive control for all of the nozzle blocks, the fifth nozzle is driven to discharge ink, in the 32nd drive control, the 32nd nozzle is driven, in the 33rd drive control, the second nozzle is driven, and so on. Further, the nozzles may be driven in the order of the first nozzle, the 128th nozzle, the second nozzle, the 127th nozzle, and so on, or in another order from the first nozzle, the 65th nozzle, the second nozzle, the 66th nozzle, and so on. The alternate drive control method provides a better preparatory head drive since the head is uniformly heated. Software may be used for selecting the nozzle to be driven for ink discharge and the nozzle not to be driven for ink discharge but heated. As a matter of course, the nozzle select function may be realized by hardware. If so designed, the load on the software is lightened.

In the nozzle drive mode (2), four nozzles are driven to discharge ink, while 124 nozzles are driven to such an extent as not to discharge ink. In this case, the four nozzles to be driven for ink discharge are contained in one nozzle block. Accordingly, the print data to be applied to the head is set so as to drive all of the nozzles. A drive pulse signal used in this nozzle drive mode is similar to the drive pulse signal shown in FIG. 12, that is used in the nozzle drive mode (1). It is assumed that as in the nozzle drive mode (2) in FIG. 8, for example, the first nozzle drive control for all of the nozzle blocks causes the first to fourth nozzles to discharge ink. The energy consumed in the first nozzle drive control for all of the nozzle blocks is the sum of the energy consumed by driving the four nozzles for discharging ink and the energy consumed by driving the remaining 124 nozzles to such an extent as not to discharge ink.

In the second nozzle drive control for all of the nozzle blocks, the four nozzles in another nozzle block are driven to discharge ink. To this end, a drive pulse signal of the pulse width wide enough to discharge ink is used for the drive pulse signal for driving the nozzle block to be driven for ink discharge. When the 5th to 8th nozzles, for example, are driven for ink discharge by the second nozzle drive control for all of the nozzle blocks, a drive pulse signal of the pulse width wide enough to discharge ink is used for the drive pulse signal for driving the second nozzle block. Any nozzle block may be driven in any nozzle order. For example, the 65th to 68th nozzles, or the 17th nozzle block, may be driven for ink discharge. The 125th to 128th nozzles, or the 32nd nozzle block, may also be driven. Through 32 (the number of nozzle blocks) nozzle drive controls for all of the nozzle blocks, all of the nozzles are each driven for ink discharge one time. This sequence of operations is repeated until the head is heated to a preset temperature T (°C.). The frequency at which one nozzle is driven for ink discharge is 1/32 as high as the frequency at which all the nozzle blocks are driven in the preparatory head drive mode. In this nozzle drive mode, the heat value is large since the number of nozzles to discharge ink is larger than that in the nozzle drive mode (1).

In the nozzle drive mode (3), the nozzle blocks each driven for ink discharge by one nozzle and the nozzle blocks each driven to such an extent as to not discharge ink are alternately arranged. More specifically, since there are 16 nozzle blocks each of which contains one nozzle to be driven to discharge ink, ink is discharged from 16 nozzles. The remaining 16 nozzle blocks are driven to such an extent as to not discharge ink. As a result, 64 nozzles are driven to be heated. In the first nozzle drive control for all of the nozzle blocks, the print data is set for the odd-numbered nozzle blocks so that each nozzle of each of those nozzle blocks is driven to discharge ink. In this instance of the embodiment, let the nozzles to be driven by the nozzles each having the youngest number in the nozzles of each nozzle block, that is, 1st nozzle, 9th nozzle, . . . , 121th nozzle. For the even-numbered nozzle blocks, the print data is set so as to drive all of the four nozzles for ink discharge. The nozzle blocks are sequentially driven from the first nozzle and the subsequent ones. The first nozzle block is driven so that ink is discharged from only the first nozzle while no ink is discharged from the remaining ones, the second, third, and fourth nozzles. Accordingly, the energy to drive one nozzle is consumed in this nozzle drive. The second nozzle block is driven so that no ink is discharged from the four nozzles. In this drive, such a quantity of energy as not to discharge ink is consumed for the respective four nozzles. In the third nozzle block, as in the first nozzle block, only the 9th nozzle is driven for ink discharge, while the remaining three nozzles are not driven. Accordingly, this drive consumes the energy to drive one nozzle for ink discharge. In this way, the nozzle blocks are successively driven. The 31 nozzle block is driven so that one nozzle, or the 121th nozzle, discharges ink. The energy for driving one nozzle to discharge ink is consumed. The 32nd nozzle block is driven to such an extent that the four nozzles do not discharge ink. Such a quantity of energy as to drive the four nozzles to fail to discharge ink is consumed. In the first nozzle drive control for all of the nozzle blocks, each odd-numbered nozzle block consumes the energy for driving one nozzle to discharge ink. Each even-numbered nozzle consumes such a quantity of energy as to drive the four nozzles to fail to discharge ink. The total energy consumed by one nozzle drive control for all of the nozzle blocks is the sum of the energy for driving 16 nozzles to discharge ink and the energy for driving 64 nozzles to such an extent as not to discharge ink.

In the second nozzle drive control for all of the nozzle blocks, each odd-numbered nozzle block is driven to such an extent as not to discharge ink, and each even-numbered nozzle block is driven so as to cause one nozzle to discharge ink. That is, the 5th nozzle, 13th nozzle, . . . , 125th nozzle are driven to discharge ink. The second nozzle drive control is different from the first one only in that the operation of the odd-numbered nozzle block is replaced with that of the even-numbered nozzle block. Therefore, no further description of the operation will be given here. In the third nozzle drive control for all of the nozzle blocks, each odd-numbered nozzle block is driven so as to cause one nozzle to discharge ink, and each even-numbered nozzle block is driven to such an extent as to not discharge ink. The nozzles to be driven for ink discharge are different from those in the first nozzle drive control for all of the nozzle blocks; for example, the 2nd, 10th, . . . , 122th the nozzles may be driven for ink discharge. In this way, the odd-numbered nozzle blocks and the even-numbered nozzle blocks are alternately driven for ink discharge and heating, and further all of the nozzle blocks are repeatedly driven while switching the nozzles to be driven. All of the nozzle blocks are repeatedly driven 8 times till all of the nozzles are driven. This sequence of operations is repeated till the head is heated up to a preset temperature T (°C.). The frequency at which one nozzle is driven for ink discharge is ⅛ as high as the frequency at which all the nozzle blocks are driven in the preparatory head drive mode.

When comparing with nozzle drive mode (2), the number of the nozzles to be driven for ink discharge is larger, but the number of the nozzles driven to such an extent as to not discharge ink is smaller. The heat value is larger than that in the nozzle drive mode (2). As seen from the illustration of the nozzle drive mode (3) shown in FIG. 8, a nozzle layout in which the ink discharging nozzles are contained in the alternate nozzle blocks, provides a uniform heating of the whole head.

In the nozzle drive mode (4), the nozzle blocks to be driven to discharge ink and the nozzle blocks to be driven so as to not discharge ink are alternately arrayed. In this drive mode, unlike the nozzle drive mode (3), the four nozzles are all driven for ink discharge in each nozzle block to be driven for ink discharge. In thee first nozzle drive control for all of the nozzle blocks, the odd-numbered nozzle blocks are driven for ink discharge, while the even-numbered nozzle blocks are driven for heating. In other words, 64 nozzles are driven for ink discharge, while the remaining 64 nozzles are driven to such an extent as to not discharge ink. Each of the 16 odd-numbered nozzle blocks consumes the energy to drive the four nozzles for ink discharge, while each of the 16 even-numbered nozzle blocks consumes the energy for driving the nozzles to such an extent as not to discharge ink. Thus, one nozzle drive control for all of the nozzle blocks consumes the sum of the energy to drive 64 nozzles to discharge ink and the energy to drive 64 nozzles to such an extent as not to discharge ink. In the second nozzle drive control for all of the nozzle blocks, the odd-numbered nozzle blocks are driven to such an extent as not to discharge ink, while the even-numbered nozzle blocks are driven for ink discharge. As the result of two nozzle drive controls for all of the nozzle blocks, all of the nozzles are each driven one time. This sequence of operations is repeated till the head is heated up to a preset temperature T (°C.). The frequency at which one nozzle is driven for ink discharge is ½ as high as the frequency at which all the nozzle blocks are driven in the preparatory head drive mode. When comparing with the nozzle drive modes (1) to (3), the number of the nozzles to discharge ink is larger and hence the head is rapidly heated.

In the nozzle drive mode (5), all of the nozzles are driven for ink discharge. In this mode, the first nozzle drive control for all of the nozzle blocks causes all of the nozzles to discharge ink. The energy consumed through one nozzle drive control for all of the nozzle blocks drives 128 nozzles for ink discharge. In this mode, the heat value is large so as to rapidly heat the head. However, the quantity of discharge ink is large, and the power consumption is large. The nozzle drive mode (5) is preferably applied to the case where the clogged nozzles can be cured by several ink discharging operations or combined with another nozzle drive mode. When the head is preparatorily driven not using this nozzle drive mode (5), the maximum current dissipation can be reduced in the preparatory head drive mode. Particularly when a plural number of heads are simultaneously driven, this nozzle drive mode (5) functions effectively.

In the nozzle drive mode (6), all of the nozzles are driven to such an extent as not to discharge ink. In this mode, none of the nozzles is driven to discharge ink. The energy consumed through one nozzle drive control for all of the nozzle blocks drives 128 nozzles to such an extent as not to discharge ink. In this mode, none of the nozzles is driven to discharge ink, as mentioned above. Only the head temperature rise is used for curing the clogged-nozzle. Further, since the nozzles are driven at a low heat value so as to inhibit all of the nozzles from discharging ink, the heat temperature rise effect is smaller than that in the nozzle drive mode (1).

Figure 9:
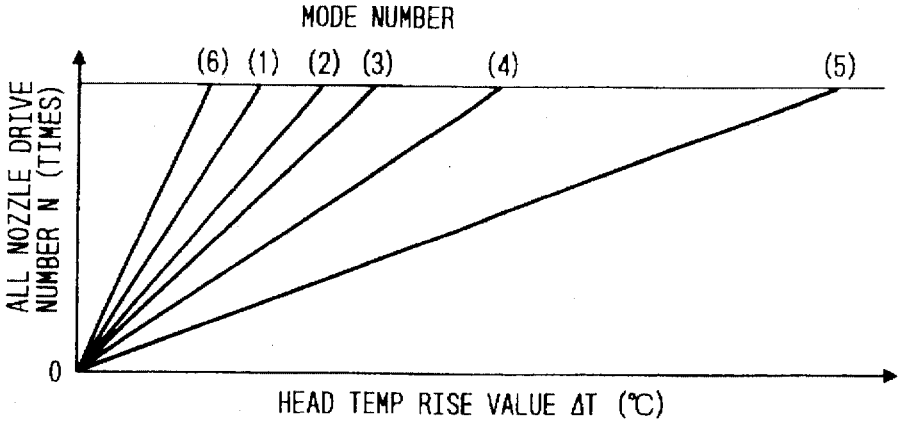
FIG. 9 is a graph showing temperature rise tendencies of the nozzle drive modes in the preparatory head drive operation.

FIG. 9 is a graph showing temperature rise tendencies of the nozzle drive modes in the preparatory head drive operation. FIG. 9 illustrates the relationships between the number of drives of all nozzles N and the head temperature rise values ΔT (°C.). In FIG. 9, straight lines (1) to (6) corresponds to the nozzle drive modes (1) to (6) in FIG. 8. As seen from FIG. 9, when all of the nozzles are driven a preset number of times, the nozzle drive mode (6) provides the lowest head temperature rise. Then, the resultant head temperature rise values are increased in the order of the nozzle drive modes (1), (2), . . . , and the highest head temperature rise value is obtained by the nozzle drive mode (5). The temperature rise values and the nozzle drive mode numbers are tabulated and stored in the program ROM 6, for example, in FIG. 1. In the step S54 of FIG. 7, the CPU retrieves from the table in the program ROM 6 the nozzle drive mode number whose contents are the same as or similar to the number of discharge actions (n/ΔT) per nozzle when the head temperature is raised 1° C., which is calculated in the step S53.

When the ink jet printer is located in low temperature conditions or left standing for a long time, the nozzle drive arrangement as of the nozzle drive mode (4) is selected. Accordingly, the head is rapidly heated, reducing the time for the preparatory head drive operation. When the ambient temperature in a place where the printer is located is relatively near the operating temperature and the left-standing time is relatively short, the nozzle drive arrangement as of the nozzle drive mode (1) is selected. The head temperature is gently raised. Wasteful ink consumption is minimized, saving ink. Thus, use of the nozzle drive modes can flexibly handle various types of preparatory head drive controls required by the printer.

Figure 10:
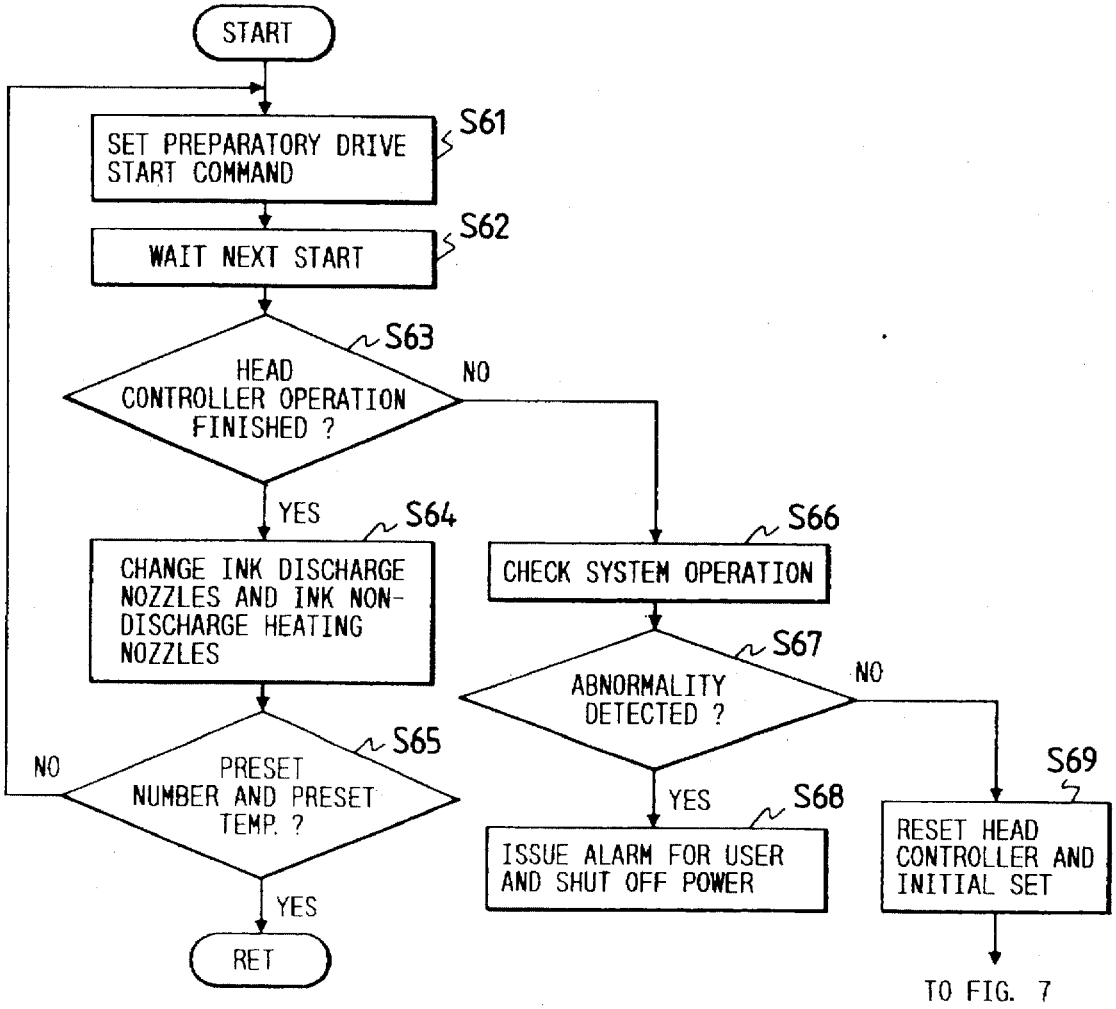
FIG. 10 is a flowchart showing the operation of the preparatory head drive in the ink jet printer.

FIG. 10 is a flowchart showing the operation of the preparatory head drive in the ink jet printer.

In the process shown in FIG. 7, when the preparatory head drive mode is set up and the number of preparatory head drive operations are determined, in a step S61, a preparatory head drive start command is issued for transfer to the print timing controller 43, and the preparatory head drive mode starts in the head control section. During this preparatory head drive operation, the CPU is placed in a stand-by mode in a step S62. In order that the CPU escapes from the stand-by mode, any of many known methods, such as a method in which it escapes from the stand-by mode after a preset time, a method based on the result of constantly monitoring an end signal issued from the head control section, and a method in which the head control section interrupts the CPU, may be used. After the CPU escapes from the stand-by mode, in a step S63, the CPU checks whether or not the operation of the head control section normally ends. If it normally ends, the CPU in a step S64 alters the nozzles to discharge ink and not to discharge ink, and alters the print data as required, according to the preparatory head drive mode. In a step S65, the CPU checks whether or not the preparatory head drive operations have been performed a preset number of times and whether or not the head temperature reaches a preset temperature. To repeat the preparatory head drive mode, the CPU returns to the step S61 where another preparatory head drive is performed. The new preparatory head drive is performed at a drive frequency F" (kHz) higher than the normal drive frequency F (kHz). The drive frequency F' (kHz) for driving one nozzle to discharge ink is lower than the normal drive frequency F (kHz). The preparatory drive frequencies will be described later in detail. When the preset number of preparatory head drive operations have been completed or the head temperature reaches the preset temperature, the preparatory head drive mode terminates and the normal print mode starts. After the preparatory head drive mode terminates and the head temperature is raised by a preset temperature rise value ΔT °C., any nozzle will have undergone the n number of ink discharging actions per nozzle that is required for curing the clogged nozzles. Accordingly, there is no need of the step 2 as already mentioned. The preparatory head drive time is reduced. Further, wasteful ink consumption is remarkably reduced.

If, after performing the preparatory head drive operation, the operation of the head control section normally ends (step S63), the CPU checks the system operation in a step S66, and judges the result of the check in a step S67. If the system operation is abnormal, the CPU shows a user its abnormality and turns off the power source. If the check result does not show any abnormality of the system operation, the CPU resets the head control section and the like in a step S69, and returns to the process of FIG. 7 where it sets up other preparatory head drive conditions again.

In this way, the CPU progressively controls and executes the preparatory head drive operations while managing the head temperature and the number of preparatory head drive actions.

Figure 14:
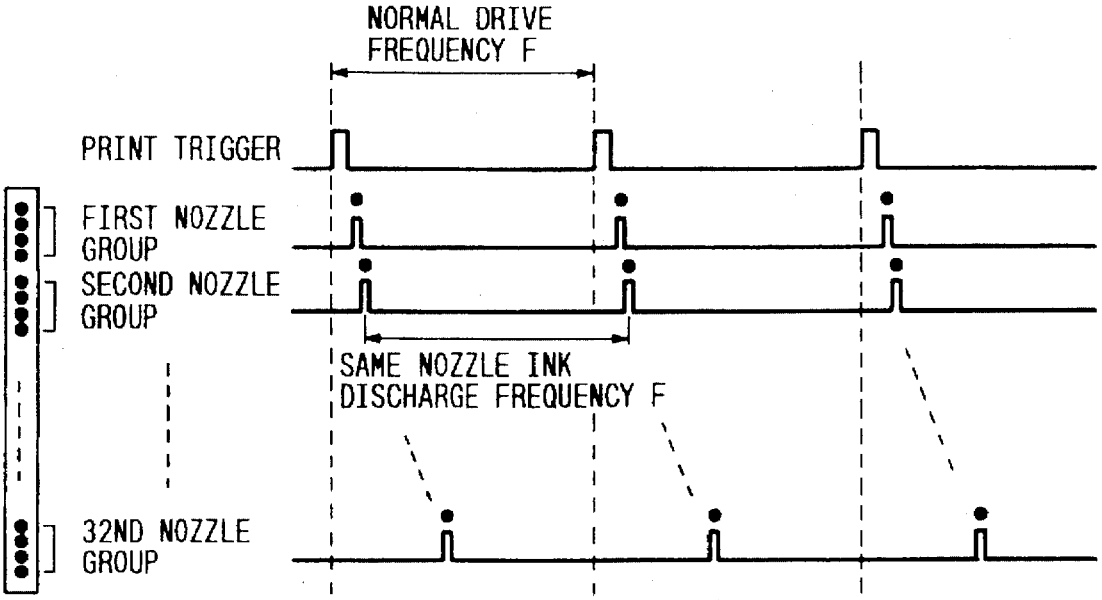
FIG. 14 is a timing chart showing the preparatory head drive operation of the ink jet printer in a nozzle drive mode where all of the nozzles are driven to discharge ink.
Figure 15:
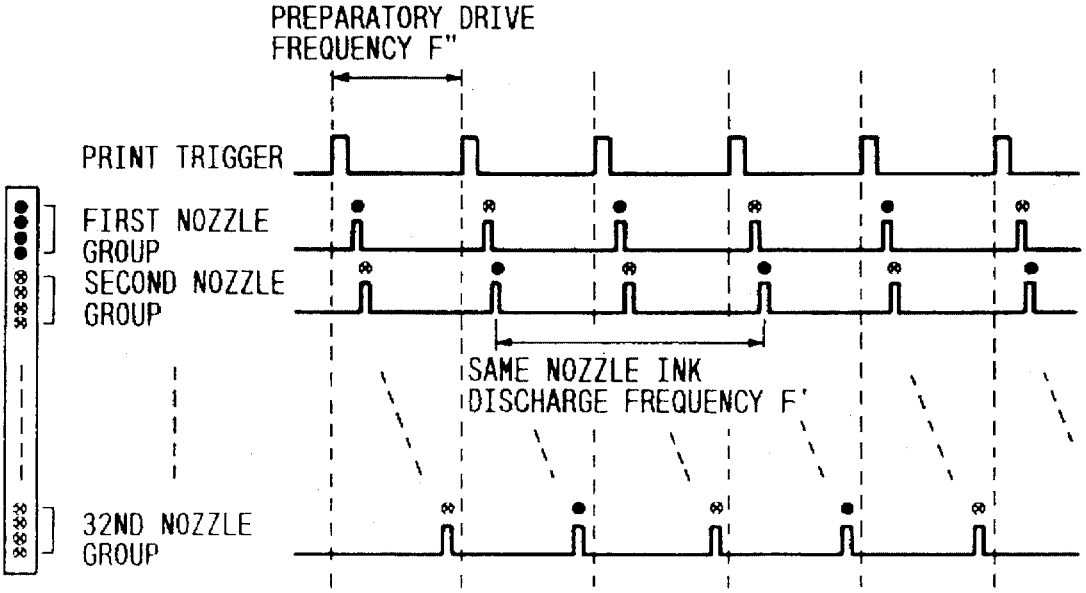
FIG. 15 is a timing chart showing the preparatory head drive operation of the ink jet printer in another nozzle drive mode.

The drive frequencies in the preparatory head drive will be described using FIGS. 14 and 15. In the figures, the nozzles marked with circular black dots are those that discharge ink and the nozzles marked with circles containing "x" therein are those driven to such an extent as not to discharge ink. FIG. 14 is a timing chart showing the preparatory head drive operation of the ink jet printer in the nozzle drive mode (5) where all of the nozzles are driven to discharge ink. In a normal print mode, the drive frequency F (kHz) as shown in FIG. 14 is used for driving the head nozzles. When all of the nozzles are driven to discharge ink, much ink is supplied to the nozzles. Therefore, it must be driven at time intervals longer than the time for driving the first to 32nd nozzle blocks for ink refilling. In the normal print, there is a possibility that the situation to cause all of the nozzles to discharge ink successively takes place. In preparation for this, the head must be driven at the normal drive frequency F (kHz). In this case, the drive frequency F' (kHz) for driving one nozzle to discharge ink is equal to the normal drive frequency F (kHz).

In the nozzle drive modes (1) to (4), and (6) in which a situation where all of the nozzles are driven, never occurs, the amount of ink supplied to the head is half or less of the amount of supplied ink in the nozzle drive mode (5). No time is needed for ink refill. Accordingly, when any nozzle drive mode other than the nozzle drive mode (5) is used for the preparatory head drive, the drive frequency F" (kHz) may be set to be higher than the normal drive frequency F (kHz). FIG. 15 is a timing chart showing the preparatory head drive operation of the ink jet printer in another nozzle drive mode. As shown in FIG. 15, the drive frequency F" (kHz) may be set to be higher than the normal drive frequency F (kHz) in the normal print mode. In the case of FIG. 15, the drive frequency F" (kHz) is about two times as high as the normal drive frequency F (kHz). As described above, the drive frequency F' (kHz) causing one nozzle to discharge ink in the nozzle drive mode (4) is ½ the drive frequency for driving all of the nozzle blocks in the preparatory head drive mode. Therefore, the drive frequency F' (kHz) is approximately equal to the normal drive frequency F (kHz). In this case, ink is discharged from all of the nozzles within one period. Then, the amount of ink discharged during one period of the normal drive frequency F (kHz) is approximate to that when 128 nozzles, i.e., all of the nozzles, are driven. On the other hand, 128 nozzles are driven to such an extent as to not discharge ink. As a result, the consumed energy, as shown in FIG. 14, is larger than that when all of the nozzles are driven for ink discharge at the normal drive frequency F (kHz). The head temperature is effectively raised.

In the nozzle drive modes (1) to (3), the drive frequency F' (kHz) causing one nozzle to discharge ink is lower than the normal drive frequency F(kHz), thereby reducing the amount of discharged ink per unit time. Since the head value by one nozzle drive control for all of the nozzle blocks is small, it is preferable to set the drive frequency F' (kHz)as high as possible. In those nozzle drive modes, F'<F<F" is preferable.

A specific preparatory head drive operation will be described. A preparatory head drive method where the total number of nozzles is 128, those nozzles are grouped into nozzle blocks each consisting of four nozzles, and the nozzles of each nozzle block are simultaneously driven, thereby minimizing wasteful ink consumption, will be described by way of example.

It is assumed that the printer is left standing for days Ct (day) and it is operated for printing in a low temperature condition of ambient temperature Tc (°C.). To start, the preparatory head drive mode, and the preparatory head drive conditions, such as the number of head drive operations, are set up according to the flowchart shown in FIG. 7.

The CPU calculates the head temperature rise value ΔT (°C.) in the step S51. Since the ambient temperature is low, $$\Delta T=-a'\cdot Tc+b'=20\ (°C.).$$

Then, in the step S53, the CPU reads from the program ROM 6 the number n of ink discharging actions per nozzle required for curing the clogged nozzles when the system is left standing for the days Ct (day). In this example, the number n is 600. In the step S53, the CPU calculates the number of ink discharging actions per nozzle during the time period of rising temperature by 1° C. in the following way under the conditions that the head temperature is risen by 20° C. and the number of nozzle discharging actions reaches 600 till the preparatory head drive mode terminates.

$$(n/\Delta T)=600/20=30\ (\text{times}/°C.)$$

As seen, the calculated number of ink discharging actions is 30. In the process of driving the total number of nozzles, i.e., 128 nozzles, the data are tabulated as data set (X, Y, Z) in the program ROM 6. X is indicative of the number of the nozzles to discharge ink, Y is representative of the number of the nozzles driven not the discharge ink, and Z indicates the number of nozzle drive controls for all of the nozzle blocks when the head temperature is risen by 1° C. under the nozzle drive arrangement. The data set (1, 124, 3800) means that one nozzle is driven to discharge ink through one preparatory head to be heated, and the necessary number of preparatory head drive operations for the temperature rise of 1° C. under the nozzle drive arrangement is 3800. This nozzle drive arrangement is that of the nozzle drive mode (1). In this nozzle drive mode, in order that all of the nozzles are each driven to discharge ink one time, the discharging operation is performed 128 times while changing the discharging nozzle every discharging operation. When the preparatory head drive is performed a total of 3800 times, each nozzle discharges ink 30 times since $$3800/128=\text{about } 30 \text{ times}.$$

In the step S54, the CPU calculates $$(Z\times X)/128,$$

and retrieves the data approximate to 30 as the number of preparatory head drive operations per nozzle from the data table in the program ROM. In this instance, (X, Y, Z) is tabulated as the data set. If (X, Y, (Z×X )/128) is tabulated as the data set, there is no need of the above calculation.

In this way, the preparation head drive mode is set up and the number of preparatory head drive operations is determined under the conditions that the print system is left standing for the days Ct (day) and the ambient temperature is Tc (°C.).

Then, the preparatory head drive mode is executed. In the preparatory head drive mode, the nozzle drive arrangement of the nozzle drive mode (1) shown in FIG. 8 is used in this instance. The CPU 3 controls the head drive control section as shown in FIG. 4 and executes the preparatory head drive according to the drive parameters determined as described above.

Data is set in the memory means in the dot count controller 45 so that to drive the first nozzle block, a drive pulse signal of the pulse width S (second) wide enough to discharge ink that is stored in the memory means 48 is applied from the drive pulse generator 44 to the heads, and to drive the 2nd to 32 nozzle blocks, a drive signal of such a pulse width S' (second) as to not discharge ink that is generated by the pulse-width data processor 47 is applied to the heads. In the print processor 49, print data is set so that the first nozzle in the first nozzle block, and all of the nozzles in the 2nd to 32nd nozzle blocks are all driven. Under this condition, the CPU 3 sends a preparatory head drive start command to the print timing controller 43 through the data bus. This sequence of operations is repeated by the number of nozzle blocks, thereby completing the first nozzle drive control for all of the nozzle blocks.

The second nozzle drive control for all of the nozzle blocks is performed so as to drive the 128th nozzle to discharge ink. Data is set in the memory means of the dot count controller 45 so that to the 1st to 31st nozzle blocks, a drive pulse signal of such a pulse width S' (second) as not to discharge ink is applied, and a drive pulse signal of the pulse width S (second) wide enough to discharge ink is applied to the 32nd nozzle block. In the print data processor 49, print data is set so as to drive the nozzles of the 1st to 31st nozzle blocks and the 4th nozzles of the 32nd nozzle block. Subsequently, the preparatory head drive is executed as for the first nozzle drive control for all of the nozzle blocks. The third nozzle drive control for all of the nozzle blocks drives the second nozzle for ink discharge. The fourth nozzle drive control for all of the nozzle blocks drives the 127th nozzles for ink discharge. In this way, the nozzles of the head are alternately driven in a manner that a first nozzle at one end of the head is first driven, and a second nozzle at the other end thereof is then driven, a third nozzle located adjacent to the first nozzle is driven, a fourth nozzle located adjacent to the second nozzle, and so on. The thus operated nozzle drive for all of the nozzle blocks is repeated 76000 times since $$3800\ (\text{times}/°C.)\times 20°\ C.=76000\ \text{time}.$$

For the nozzle drive control for all of the nozzle blocks, the preparatory drive frequency F" (kHz), higher than the normal drive frequency F (kHz) is used. The drive frequency F' (kHz) for driving one nozzle to discharge ink is 1/28 the preparatory drive frequency, as seen from the description of the nozzle drive mode (1). If the drive frequency F" (kHz) is approximately two times the normal drive frequency F (kHz), the frequency F' (kHz) for driving one nozzle to discharge ink is 1/64 the preparatory drive frequency. F'<F<F" holds.

The head temperature is frequency sensed during the preparatory head drive operation, to check whether or not it is the preset temperature shown in the equation (2). When it does not reach the preset temperature, the preparatory head drive operation continues after a preset number of preparatory head drive operations, thereby carrying out the preparatory head drive control while changing the ink discharging nozzles.

While the present invention has been described using the ink jet printer, it is evident that the present invention is applicable for other systems, such as ink-jet basis facsimile devices, and copying machines.

As seen from the foregoing description, a preparatory drive method for effecting the head temperature rise by driving the nozzles to such an extent as to not discharge ink and another preparatory drive method for effecting the same by driving the nozzles so as to discharge ink are concurrently executed in the same preparatory drive mode. A rapid preparatory head drive is realized.

Use of parameters efficacious in curing the clogged nozzles, such as the head temperature rise condition and the drive frequency, reduces the number of ink discharging actions when compared with the conventional preparatory head drive method. The result is to reduce wasteful ink consumption and thereby to save ink.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of preparatively driving a head for an ink jet printer, said method comprising the steps of:

detecting a current head temperature t (°C.); and continuously executing a preparatory head drive operation until said current head temperature reaches a predetermined head temperature T (°C.) given by a linear relationship between ambient temperature and head set temperature:

$$T=a\cdot t+b(°C.)$$

wherein "a" is a variable defining a slope of the linear relationship and "b" is a variable representing the y-intercept of the linear relationship.

2. A method according to claim 1 wherein said predetermined head temperature T(°C.) is $$T=0.5t+23\ (°C.).$$

3. A method of preparatively driving a head including a plurality of nozzles for an ink jet printer, said method comprising the steps of:

grouping said nozzles into nozzle blocks, each consisting of a predetermined number of nozzles, so that said nozzles are sequentially driven, every nozzle block, for ink discharge with predetermined time lags;

driving said nozzles so as to discharge ink from said nozzles as a preparatory discharge drive operation;

driving said nozzles to such an extent as not to discharge the ink from said nozzles as a preparatory heating drive operation, wherein said preparatory discharge drive operation and said preparatory heating drive operation are alternately executed and a time interval between one preparatory discharge drive operation and the next preparatory discharge drive operation for each nozzle is longer than a time interval of the normal drive in a normal head drive mode, and a time interval between one preparatory heating drive operation and the next preparatory heating drive operation for each nozzle is shorter than said time interval of the normal drive in a normal head drive mode.

4. A method according to claim 3, further comprising the steps of:

detecting a current head temperature t (°C.); and continuously executing said preparatory discharge drive operation and said preparatory heating drive operation until said current head temperature reaches a predetermined head temperature T(°C.) given by a linear relationship between ambient temperature and head set temperature:

$$T=a\cdot t+b(°C.)$$

wherein "a" is a variable defining a slope of the linear relationship and "b" is a variable representing the y-intercept of the linear relationship.

5. A method according to claim 4, wherein said predetermined head temperature T(°C.) is $$T=0.5t+23\ (°C.).$$

6. A method of preparatively driving a head including a plurality of nozzles for an ink jet printer, the method comprising the steps of:

grouping said nozzles into nozzle blocks each consisting a predetermined number of nozzles, so that said nozzles are sequentially driven, every nozzle block, for ink discharge with predetermined time lags;

driving said nozzles so as to discharge ink from said nozzles as a preparatory discharge drive operations;

driving said nozzles to such an extent as not to discharge the ink from said nozzles as a preparatory heating drive operation;

wherein one preparatory drive operation for all nozzles is performed by alternating said preparatory discharge drive operation for each of said nozzle groups with said preparatory heating drive operation for each of said nozzle groups, and a time interval between one preparatory discharge drive operation and the next preparatory discharge drive operation for each of said nozzle groups is longer than a time interval of the normal drive operation in a normal head drive mode, and a time interval between one of said preparatory heating drive operation and the next preparatory heating drive operation for each of said nozzle groups in shorter than said time interval of the normal drive operation in a normal head drive mode.

7. An apparatus for preparatory driving a print head including a plurality of nozzles for an ink jet printer, comprising:

first driving means for driving said nozzles so as to discharge ink from said nozzles as a preparatory drive operation;

second driving means for driving said nozzles to such an extent as to not discharge the ink from said nozzles as a preparatory heating drive operation; and a head controller for controlling the timing of discharge ink from the nozzles of each print head of the ink jet printer such that said preparatory discharge drive operation and said preparatory heating drive operation are alternatively executed wherein a time interval between one preparatory discharge drive operation and the next preparatory discharge drive operation for each nozzle is longer than a time interval of the normal drive in a normal head drive mode, and a time interval between one preparatory heating drive operation and the next preparatory heating drive operation for each nozzle is shorter than said time interval of the normal drive in a normal head drive mode.

8. A method of preparatively driving a head including a plurality of nozzles for an ink jet printer, said method comprising the steps of:

grouping said nozzles into nozzle blocks, each consisting of a predetermined number of nozzles, so that said nozzles are sequentially driven, every nozzle block, for ink discharge with predetermined time lags;

driving said nozzles so as to discharge ink from said nozzles as a preparatory discharge drive operation;

driving said nozzles to such an extent as not to discharge the ink from said nozzles as a preparatory heating drive operation;

detecting a current head temperature t (°C.); and continuously executing said preparatory discharge drive operation and said preparatory heating drive operation until said current head temperature reaches a predetermined head temperature T(°C.) given by a linear relationship between ambient temperature and head set temperature:

$$T=a\cdot t+b(°C.)$$

wherein "a" is a variable defining a slope of the linear relationship and "b" is a variable representing the y-intercept of the linear relationship, and wherein said preparatory discharge drive operation and said preparatory heating drive operation are alternately executed.

9. An apparatus for preparatory driving a print head including a plurality of nozzles for an ink jet printer, comprising:

first driving means for driving said nozzles so as to discharge ink from said nozzles as a preparatory drive operation;

second driving means for driving said nozzles to such an extent as to not discharge the ink from said nozzles as a preparatory heating drive operation;

a head controller for controlling the timing of discharge ink from the nozzles of each print head of the ink jet printer such that said preparatory discharge drive operation and said preparatory heating drive operation are alternatively executed; and detector means for detecting the current head temperature t (°C.)

wherein said head controller continuously executes said preparatory drive operation and said preparatory heating drive operation until said detector means detects that said current head temperature has reached a predetermined head temperature T(°C.) given by a linear relationship between ambient temperature and head set temperature:

$$T=a\cdot t+b(°C.)$$

wherein "a" is a variable defining a slope of the linear relationship and "b" is a variable representing the y-intercept of the linear relationship.

* * * * *